US008862465B2

(12) United States Patent
Krishnan et al.

(10) Patent No.: US 8,862,465 B2
(45) Date of Patent: Oct. 14, 2014

(54) DETERMINING PITCH CYCLE ENERGY AND SCALING AN EXCITATION SIGNAL

(75) Inventors: Venkatesh Krishnan, San Diego, CA (US); Stephane Pierre Villette, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 256 days.

(21) Appl. No.: 13/228,046

(22) Filed: Sep. 8, 2011

(65) Prior Publication Data

US 2012/0072208 A1 Mar. 22, 2012

Related U.S. Application Data

(60) Provisional application No. 61/384,106, filed on Sep. 17, 2010.

(51) Int. Cl.

| | |
|---|---|
| ***G10L 21/00*** | (2013.01) |
| ***G10L 19/00*** | (2013.01) |
| ***G10L 19/12*** | (2013.01) |
| ***G10L 21/02*** | (2013.01) |
| ***G10L 19/02*** | (2013.01) |
| ***G10L 13/00*** | (2006.01) |
| ***G10L 25/93*** | (2013.01) |
| ***G06F 17/28*** | (2006.01) |
| ***G10L 19/097*** | (2013.01) |

(52) U.S. Cl.

CPC ..... *G10L 19/097* (2013.01)
USPC ..... 704/207; 704/219; 704/231; 704/223; 704/228; 704/226; 704/501; 704/222; 704/201; 704/203; 704/220; 704/262; 704/2; 704/214

(58) Field of Classification Search

CPC ..... G10L 19/12; G10L 15/22; G10L 19/005; G10L 21/0208; G10L 25/93; G10L 19/06; G10L 25/90; G10L 19/008; H05K 999/99; G11C 2207/16; G10F 17/289; H04B 1/665
USPC ..... 704/200–230, 500–504
See application file for complete search history.

(56) References Cited

U.S. PATENT DOCUMENTS 3,892,919 A * 7/1975 Ichikawa ..... 704/267
4,991,213 A 2/1991 Wilson (Continued)

FOREIGN PATENT DOCUMENTS

CN 1369092 A 9/2002
CN 101335004 A 12/2008

(Continued)

OTHER PUBLICATIONS

J. Stachurski, "A Pitch Pulse Evolution Model for Linear Predictive Coding of Speech", PhD thesis, McGill University, 1998.*

(Continued)

*Primary Examiner* — Paras D Shah
*Assistant Examiner* — Anne Thomas-Homescu
(74) *Attorney, Agent, or Firm* — Austin Rapp & Hardman

(57) ABSTRACT

An electronic device for determining a set of pitch cycle energy parameters is described. The electronic device includes a processor and executable instructions stored in memory. The electronic device obtains a frame, a set of filter coefficients and a residual signal based on the frame and the set of filter coefficients. The electronic device determines a set of peak locations based on the residual signal and segments the residual signal such that each segment includes one peak. The electronic device determines a first set of pitch cycle energy parameters based on a frame region between two consecutive peak locations and maps regions between peaks in the residual signal to regions between peaks in a synthesized excitation signal to produce a mapping. The electronic device determines a second set of pitch cycle energy parameters based on the first set of pitch cycle energy parameters and the mapping.

42 Claims, 13 Drawing Sheets

(56) References Cited

U.S. PATENT DOCUMENTS

| | | | | |
|---|---|---|---|---|
| 5,781,880 | A * | 7/1998 | Su | 704/207 |
| 5,946,651 | A * | 8/1999 | Jarvinen et al. | 704/223 |
| 5,999,897 | A * | 12/1999 | Yeldener | 704/207 |
| 6,226,604 | B1 | 5/2001 | Ehara et al. | |
| 6,311,154 | B1 | 10/2001 | Gersho et al. | |
| 6,470,313 | B1 | 10/2002 | Ojala | |
| 6,526,376 | B1 | 2/2003 | Villette et al. | |
| 6,581,031 | B1 * | 6/2003 | Ito et al. | 704/222 |
| 6,973,424 | B1 * | 12/2005 | Ozawa | 704/219 |
| 2002/0007272 | A1 * | 1/2002 | Ozawa | 704/223 |
| 2005/0065788 | A1 * | 3/2005 | Stachurski | 704/229 |
| 2007/0136052 | A1 * | 6/2007 | Gao et al. | 704/207 |
| 2007/0185708 | A1 * | 8/2007 | Manjunath et al. | 704/207 |
| 2008/0140395 | A1 * | 6/2008 | Yeldener | 704/226 |
| 2009/0043574 | A1 * | 2/2009 | Gao et al. | 704/223 |
| 2009/0319261 | A1 | 12/2009 | Gupta et al. | |
| 2009/0319263 | A1 * | 12/2009 | Gupta et al. | 704/229 |
| 2012/0221336 | A1 * | 8/2012 | Degani et al. | 704/250 |
| 2013/0024193 | A1 * | 1/2013 | Yeldener et al. | 704/225 |

FOREIGN PATENT DOCUMENTS

| | | | |
|---|---|---|---|
| CN | 101572093 | A | 11/2009 |
| GB | 2398983 | A | 9/2004 |
| JP | H05502517 | A | 4/1993 |
| JP | H1097294 | A | 4/1998 |
| WO | WO-9106943 | A2 | 5/1991 |
| WO | WO-2009155569 | A1 | 12/2009 |

OTHER PUBLICATIONS

3GPP2-Drafts, 2500 Wilson Boulevard, Suite 300, Arlington, Virginia 22201 USA, Apr. 25, 2000-Apr. 28, 2000 XP040352994, Full-Rate PPPWI and Quarter-Rate PPPWI, pp. 6-8; figure 3.

Geiser et al., "Bandwidth Extension for Hierarchical Speech and Audio Coding in ITU-T Rec. G.729.1" IEEE Transactions on Audio, Speech and Language Processing, IEEE Service Center, New York, NY, USA, vol. 15, No. 8, Nov. 1, 2007, pp. 2496-2509, XP011192970, ISSN: 1558-7916, DOI: 10.1109/TASL.2007.907330.

International Search Report and Written Opinion—PCT/US2011/051051—ISA/EPO—Dec. 9, 2011.

Stachurski, "A Pitch Pulse Evolution Model for Linear Predictive Coding of Speech," A Thesis, Dept. of Electrical Engineering, McGill Univeristy, Montreal, Canada, Feb. 1998, 156 pages.

Taiwan Search Report—TW100133511—TIPO—Dec. 24, 2013.

* cited by examiner

DETERMINING PITCH CYCLE ENERGY AND SCALING AN EXCITATION SIGNAL

RELATED APPLICATIONS

This application is related to and claims priority from U.S. Provisional Patent Application Ser. No. 61/384,106 filed Sep. 17, 2010, for "SCALING AN EXCITATION SIGNAL."

TECHNICAL FIELD

The present disclosure relates generally to signal processing. More specifically, the present disclosure relates to determining pitch cycle energy and scaling an excitation signal.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform functions faster, more efficiently or with higher quality are often sought after.

Some electronic devices (e.g., cellular phones, smart phones, computers, etc.) use audio or speech signals. These electronic devices may encode speech signals for storage or transmission. For example, a cellular phone captures a user's voice or speech using a microphone. For instance, the cellular phone converts an acoustic signal into an electronic signal using the microphone. This electronic signal may then be formatted for transmission to another device (e.g., cellular phone, smart phone, computer, etc.) or for storage.

Transmitting or sending an uncompressed speech signal may be costly in terms of bandwidth and/or storage resources, for example. Some schemes exist that attempt to represent a speech signal more efficiently (e.g., using less data). However, these schemes may not represent some parts of a speech signal well, resulting in degraded performance. As can be understood from the foregoing discussion, systems and methods that improve signal coding may be beneficial.

SUMMARY

An electronic device for determining a set of pitch cycle energy parameters is disclosed. The electronic device includes a processor and instructions stored in memory that is in electronic communication with the processor. The electronic device obtains a frame. The electronic device also obtains a set of filter coefficients. The electronic device additionally obtains a residual signal based on the frame and the set of filter coefficients. The electronic device further determines a set of peak locations based on the residual signal. The electronic device also segments the residual signal such that each segment of the residual signal includes one peak. Furthermore, the electronic device determines a first set of pitch cycle energy parameters based on a frame region between two consecutive peak locations. The electronic device additionally maps regions between peaks in the residual signal to regions between peaks in a synthesized excitation signal to produce a mapping. The electronic device also determines a second set of pitch cycle energy parameters based on the first set of pitch cycle energy parameters and the mapping. Obtaining the residual signal may be further based on the set of quantized filter coefficients. The electronic device may obtain the synthesized excitation signal. The electronic device may be a wireless communication device.

The electronic device may send the second set of pitch cycle energy parameters. The electronic device may perform a linear prediction analysis using the frame and a signal prior to a current frame to obtain the set of filter coefficients and may determine a set of quantized filter coefficients based on the set of filter coefficients.

Determining a set of peak locations may include calculating an envelope signal based on an absolute value of samples of the residual signal and a window signal and calculating a first gradient signal based on a difference between the envelope signal and a time-shifted version of the envelope signal. Determining a set of peak locations may also include calculating a second gradient signal based on a difference between the first gradient signal and a time-shifted version of the first gradient signal and selecting a first set of location indices where the a second gradient signal value falls below a first threshold. Determining a set of peak locations may further include determining a second set of location indices from the first set of location indices by eliminating location indices where an envelope value falls below a second threshold relative to a largest value in the envelope and determining a third set of location indices from the second set of location indices by eliminating location indices that do not satisfy a difference threshold with respect to neighboring location indices.

An electronic device for scaling an excitation is also described. The electronic device includes a processor and instructions stored in memory that is in electronic communication with the processor. The electronic device obtains a synthesized excitation signal, a set of pitch cycle energy parameters and a pitch lag. The electronic device also segments the synthesized excitation signal into segments. The electronic device additionally filters each segment to obtain synthesized segments. The electronic device further determines scaling factors based on the synthesized segments and the set of pitch cycle energy parameters. The electronic device also scales the segments using the scaling factors to obtain scaled segments. The electronic device may be a wireless communication device.

The electronic device may also synthesize an audio signal based on the scaled segments and update memory. The synthesized excitation signal may be segmented such that each segment contains one peak. The synthesized excitation signal may be segmented such that each segment is of length equal to the pitch lag. The electronic device may also determine a number of peaks within each of the segments and determine whether the number of peaks within one of the segments is equal to one or greater than one.

The scaling factors may be determined according to an equation $$S_{k,m} = \frac{E_k}{\sum_{i=0}^{L_k} x_m(i)}.$$

$S_{k,m}$ may be a scaling factor for a $k^{th}$ segment, $E_k$ may be a pitch cycle energy parameter for the $k^{th}$ segment, $L_k$ may be a length of the $k^{th}$ segment and $x_m$ may be a synthesized segment for a filter output m.

The scaling factors may be determined for a segment according to an equation $$S_{k,m} = \frac{E_k}{\sum_{i=0}^{L_k} x_m(i)}.$$

$S_{k,m}$ may be a scaling factor for a $k^{th}$ segment, $E_k$ may be a pitch cycle energy parameter for the $k^{th}$ segment, $L_k$ may be a length of the $k^{th}$ segment and $x_m$ may be a synthesized segment for a filter output m if the number of peaks within the segment is equal to one. The scaling factors may be determined for a segment based on a range including at most one peak if the number of peaks within the segment is greater than one.

The scaling factors may be determined for a segment according to an equation $$S_{k,m} = \frac{E_k}{\sum_{i=j}^{n} x_m(i)}.$$

$S_{k,m}$ may be a scaling factor for a $k^{th}$ segment, $E_k$ may be a pitch cycle energy parameter for the $k^{th}$ segment, $L_k$ may be a length of the $k^{th}$ segment, $x_m$ may be a synthesized segment for a filter output m and j and n may be indices selected to include at most one peak within the segment according to an equation $|n-j| \leq L_k$.

A method for determining a set of pitch cycle energy parameters on an electronic device is also disclosed. The method includes obtaining a frame. The method also includes obtaining a set of filter coefficients. The method further includes obtaining a residual signal based on the frame and the set of filter coefficients. The method additionally includes determining a set of peak locations based on the residual signal. Furthermore, the method includes segmenting the residual signal such that each segment of the residual signal includes one peak. The method also includes determining a first set of pitch cycle energy parameters based on a frame region between two consecutive peak locations. The method additionally includes mapping regions between peaks in the residual signal to regions between peaks in a synthesized excitation signal to produce a mapping. The method further includes determining a second set of pitch cycle energy parameters based on the first set of pitch cycle energy parameters and the mapping.

A method for scaling an excitation on an electronic device is also disclosed. The method includes obtaining a synthesized excitation signal, a set of pitch cycle energy parameters and a pitch lag. The method also includes segmenting the synthesized excitation signal into segments. The method further includes filtering each segment to obtain synthesized segments. The method additionally includes determining scaling factors based on the synthesized segments and the set of pitch cycle energy parameters. The method also includes scaling the segments using the scaling factors to obtain scaled segments.

A computer-program product for determining a set of pitch cycle energy parameters is also disclosed. The computer-program product includes a non-transitory tangible computer-readable medium with instructions. The instructions include code for causing an electronic device to obtain a frame. The instructions also include code for causing the electronic device to obtain a set of filter coefficients. The instructions further include code for causing the electronic device to obtain a residual signal based on the frame and the set of filter coefficients. The instructions additionally include code for causing the electronic device to determine a set of peak locations based on the residual signal. Furthermore, the instructions include code for causing the electronic device to segment the residual signal such that each segment of the residual signal includes one peak. The instructions also include code for causing the electronic device to determine a first set of pitch cycle energy parameters based on a frame region between two consecutive peak locations. Additionally, the instructions include code for causing the electronic device to map regions between peaks in the residual signal to regions between peaks in a synthesized excitation signal to produce a mapping. The instructions further include code for causing the electronic device to determine a second set of pitch cycle energy parameters based on the first set of pitch cycle energy parameters and the mapping.

A computer-program product for scaling an excitation is also disclosed. The computer-program product includes a non-transitory tangible computer-readable medium with instructions. The instructions include code for causing an electronic device to obtain a synthesized excitation signal, a set of pitch cycle energy parameters and a pitch lag. The instructions also include code for causing the electronic device to segment the synthesized excitation signal into segments. The instructions further include code for causing the electronic device to filter each segment to obtain synthesized segments. The instructions additionally include code for causing the electronic device to determine scaling factors based on the synthesized segments and the set of pitch cycle energy parameters. The instructions also include code for causing the electronic device to scale the segments using the scaling factors to obtain scaled segments.

An apparatus for determining a set of pitch cycle energy parameters is also disclosed. The apparatus includes means for obtaining a frame. The apparatus also includes means for obtaining a set of filter coefficients. The apparatus further includes means for obtaining a residual signal based on the frame and the set of filter coefficients. The apparatus additionally includes means for determining a set of peak locations based on the residual signal. Furthermore, the apparatus includes means for segmenting the residual signal such that each segment of the residual signal includes one peak. The apparatus also includes means for determining a first set of pitch cycle energy parameters based on a frame region between two consecutive peak locations. Additionally, the apparatus includes means for mapping regions between peaks in the residual signal to regions between peaks in a synthesized excitation signal to produce a mapping. The apparatus further includes means for determining a second set of pitch cycle energy parameters based on the first set of pitch cycle energy parameters and the mapping.

An apparatus for scaling an excitation is also disclosed. The apparatus includes means for obtaining a synthesized excitation signal, a set of pitch cycle energy parameters and a pitch lag. The apparatus also includes means for segmenting the synthesized excitation signal into segments. The apparatus further includes means for filtering each segment to obtain synthesized segments. The apparatus additionally includes means for determining scaling factors based on the synthesized segments and the set of pitch cycle energy parameters. Furthermore, the apparatus includes means for scaling the segments using the scaling factors to obtain scaled segments.

DETAILED DESCRIPTION

Figure 1:
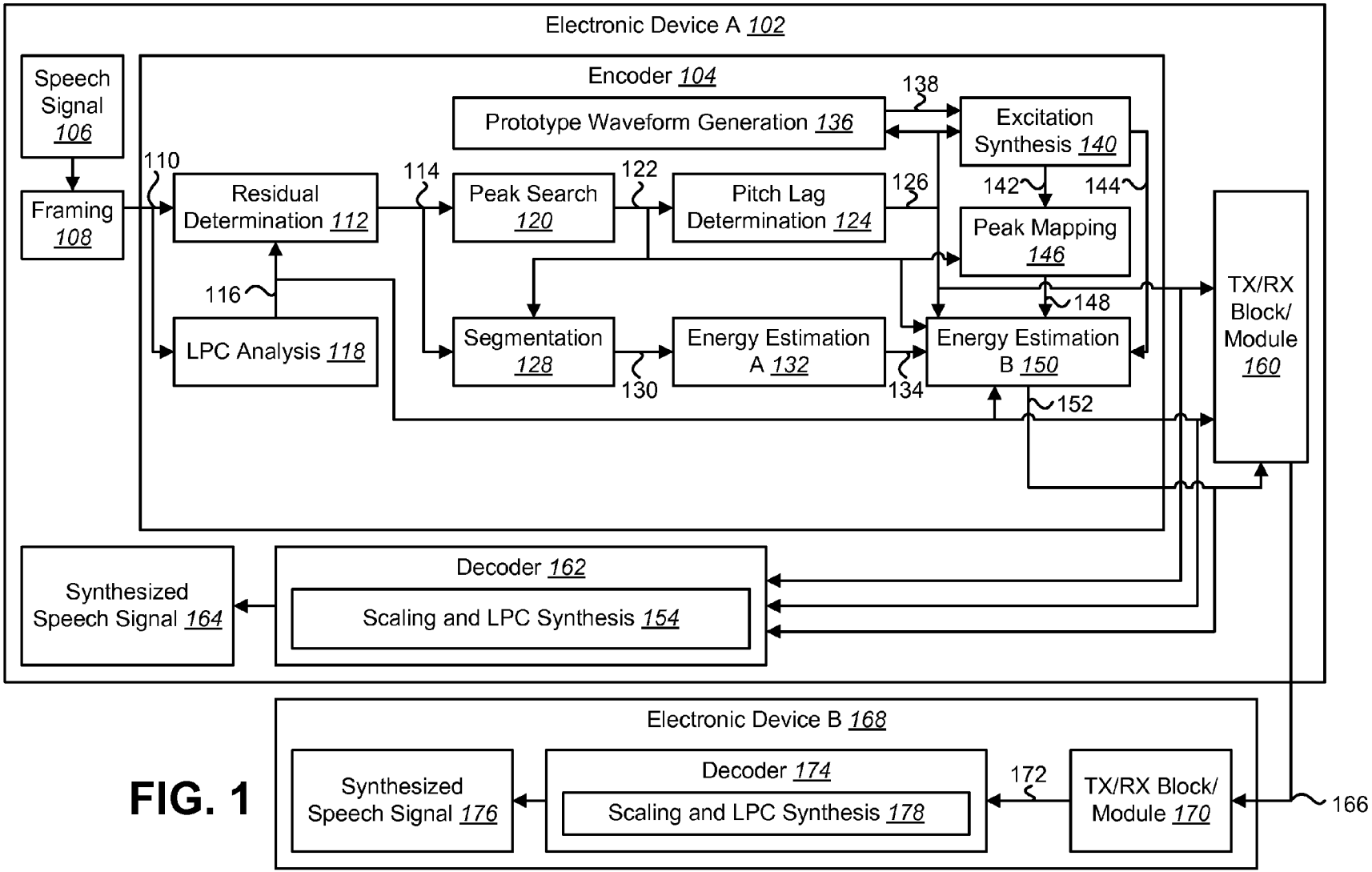
FIG. 1 is a block diagram illustrating one configuration of an electronic device in which systems and methods for determining pitch cycle energy and/or scaling an excitation signal may be implemented.

The systems and methods disclosed herein may be applied to a variety of electronic devices. Examples of electronic devices include voice recorders, video cameras, audio players (e.g., Moving Picture Experts Group-1 (MPEG-1) or MPEG-2 Audio Layer 3 (MP3) players), video players, audio recorders, desktop computers/laptop computers, personal digital assistants (PDAs), gaming systems, etc. One kind of electronic device is a communication device, which may communicate with another device. Examples of communication devices include telephones, laptop computers, desktop computers, cellular phones, smartphones, wireless or wired modems, e-readers, tablet devices, gaming systems, cellular telephone base stations or nodes, access points, wireless gateways and wireless routers.

An electronic device or communication device may operate in accordance with certain industry standards, such as International Telecommunication Union (ITU) standards and/or Institute of Electrical and Electronics Engineers (IEEE) standards (e.g., Wireless Fidelity or "Wi-Fi" standards such as 802.11a, 802.11b, 802.11g, 802.11n and/or 802.11ac). Other examples of standards that a communication device may comply with include IEEE 802.16 (e.g., Worldwide Interoperability for Microwave Access or "WiMAX"), Third Generation Partnership Project (3GPP), 3GPP Long Term Evolution (LTE), Global System for Mobile Telecommunications (GSM) and others (where a communication device may be referred to as a User Equipment (UE), NodeB, evolved NodeB (eNB), mobile device, mobile station, subscriber station, remote station, access terminal, mobile terminal, terminal, user terminal, subscriber unit, etc., for example). While some of the systems and methods disclosed herein may be described in terms of one or more standards, this should not limit the scope of the disclosure, as the systems and methods may be applicable to many systems and/or standards.

It should be noted that some communication devices may communicate wirelessly and/or may communicate using a wired connection or link. For example, some communication devices may communicate with other devices using an Ethernet protocol. The systems and methods disclosed herein may be applied to communication devices that communicate wirelessly and/or that communicate using a wired connection or link. In one configuration, the systems and methods disclosed herein may be applied to a communication device that communicates with another device using a satellite.

The systems and methods disclosed herein may be applied to one example of a communication system that is described as follows. In this example, the systems and methods disclosed herein may provide low bitrate (e.g., 2 kilobits per second (Kbps)) speech encoding for geo-mobile satellite air interface (GMSA) satellite communication. More specifically, the systems and methods disclosed herein may be used in integrated satellite and mobile communication networks. Such networks may provide seamless, transparent, interoperable and ubiquitous wireless coverage. Satellite-based service may be used for communications in remote locations where terrestrial coverage is unavailable. For example, such service may be useful for man-made or natural disasters, broadcasting and/or fleet management and asset tracking. L- and/or S-band (wireless) spectrum may be used.

In one configuration, a forward link may use 1× Evolution Data Optimized (EV-DO) Rev A air interface as the base technology for the over-the-air satellite link. A reverse link may use frequency-division multiplexing (FDM). For example, a 1.25 megahertz (MHz) block of reverse link spectrum may be divided into 192 narrowband frequency channels, each with a bandwidth of 6.4 kilohertz (kHz). The reverse link data rate may be limited. This may present a need for low bit rate encoding. In some cases, for example, a channel may be able to only support 2.4 Kbps. However, with better channel conditions, 2 FDM channels may be available, possibly providing a 4.8 Kbps transmission.

On the reverse link, for example, a low bit rate speech encoder may be used. This may allow a fixed rate of 2 Kbps for active speech for a single FDM channel assignment on the reverse link. In one configuration, the reverse link uses a ¼ convolution coder for basic channel coding.

In some configurations, the systems and methods disclosed herein may be used in one or more coding modes. For example, the systems and methods disclosed herein may be used in conjunction with or alternatively from quarter rate voiced coding using prototype pitch-period waveform interpolation. In prototype pitch-period waveform interpolation (PPPWI), a prototype waveform may be used to generate interpolated waveforms that may replace actual waveforms, allowing a reduced number of samples to produce a reconstructed signal. PPPWI may be available at full rate or quarter rate and/or may produce a time-synchronous output, for example. Furthermore, quantization may be performed in the frequency domain in PPPWI. QQQ may be used in a voiced encoding mode (instead of FQQ (effective half rate), for example). QQQ is a coding pattern that encodes three consecutive voiced frames using quarter rate prototype pitch period waveform interpolation (QPPP-WI) at 40 bits per frame (2 kilobits per second (kbps) effectively). FQQ is a coding pattern in which three consecutive voiced frames are encoded using full rate prototype pitch period (PPP), quarter rate prototype pitch period (QPPP) and QPPP respectively. This may achieve an average rate of 4 kbps. The latter may not be used in a 2 kbps vocoder. It should be noted that quarter rate prototype pitch period (QPPP) may be used in a modified fashion, with no delta encoding of amplitudes of prototype representation in the frequency domain and with 13-bit line spectral frequency (LSF) quantization. In one configuration, QPPP may use 13 bits for LSFs, 12 bits for a prototype waveform amplitude, six bits for prototype waveform power, seven bits for pitch lag and two bits for mode, resulting in 40 bits total.

In some configurations, the systems and method disclosed herein may be used for a transient encoding mode (which may provide seed needed for QPPP). This transient encoding mode (in a 2 Kbps vocoder, for example) may use a unified model for coding up transients, down transients and voiced transients. The transient coding mode may be applied to a transient frame, for example, which may be situated on the boundary between one speech class and another speech class. For instance, a speech signal may transition from an unvoiced sound (e.g., f, s, sh, th, etc.) to a voiced sound (e.g., a, e, i, o, u, etc.). Some transient types include up transients (when transitioning from an unvoiced to a voiced part of a speech signal, for example), plosives, voiced transients (e.g., Linear Predictive Coding (LPC) changes and pitch lag variations) and down transients (when transitioning from a voiced to an unvoiced or silent part of a speech signal such as word endings, for example).

The systems and methods disclosed herein describe coding one or more audio or speech frames. In one configuration, the systems and methods disclosed herein may use analysis of peaks in a residual and linear predictive coding (LPC) filtering of a synthesized excitation.

The systems and methods disclosed herein describe simultaneously scaling and LPC filtering an excitation signal to match the energy contour of a speech signal. In other words, the systems and methods disclosed herein may enable synthesis of speech by pitch synchronous scaling of an LPC filtered excitation.

LPC-based speech coders employ a synthesis filter at the decoder to generate decoded speech from a synthesized excitation signal. The energy of this synthesized signal may be scaled to match the energy of the speech signal being coded. The systems and methods disclosed herein describe scaling and filtering the synthesized excitation signal in a pitch synchronous manner. This scaling and filtering of the synthesized excitation may be done either for every pitch epoch of the synthesized excitation as determined by a segmentation algorithm or on a fixed interval which may be a function of a pitch lag. This enables scaling and synthesizing on a pitch-synchronous basis, thus improving decoded speech quality.

As used herein, terms such as "simultaneous," "match" and "synchronous" may or may not imply exactness. For example, "simultaneous" may or may not mean that two events are occurring at exactly the same time. For instance, it may mean that the occurrence of two events overlaps in time. "Match" may or may not mean an exact match. "Synchronous" may or may not mean that events are occurring in a precisely synchronized fashion. The same interpretation may be applied to other variations of the aforementioned terms.

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

FIG. 1 is a block diagram illustrating one configuration of an electronic device 102 in which systems and methods for determining pitch cycle energy and/or scaling an excitation signal may be implemented. Electronic device A 102 may include an encoder 104. One example of the encoder 104 is a Linear Predictive Coding (LPC) encoder. The encoder 104 may be used by electronic device A 102 to encode a speech (or audio) signal 106. For instance, the encoder 104 encodes frames 110 of a speech signal 106 into a "compressed" format by estimating or generating a set of parameters that may be used to synthesize or decode the speech signal 106. In one configuration, such parameters may represent estimates of pitch (e.g., frequency), amplitude and formants (e.g., resonances) that can be used to synthesize the speech signal 106.

Electronic device A 102 may obtain a speech signal 106. In one configuration, electronic device A 102 obtains the speech signal 106 by capturing and/or sampling an acoustic signal using a microphone. In another configuration, electronic device A 102 receives the speech signal 106 from another device (e.g., a Bluetooth headset, a Universal Serial Bus (USB) drive, a Secure Digital (SD) card, a network interface, wireless microphone, etc.). The speech signal 106 may be provided to a framing block/module 108. As used herein, the term "block/module" may be used to indicate that a particular element may be implemented in hardware, software or a combination of both.

Electronic device A 102 may format (e.g., divide, segment, etc.) the speech signal 106 into one or more frames 110 (e.g., a sequence of frames 110) using the framing block/module 108. For instance, a frame 110 may include a particular number of speech signal 106 samples and/or include an amount of time (e.g., 10-20 milliseconds) of the speech signal 106. The speech signal 106 in the frames 110 may vary in terms of energy. The systems and methods disclosed herein may be used to estimate "target" pitch cycle energy parameters and/or scale an excitation to match the energy from the speech signal 106 using the pitch cycle energy parameters.

In some configurations, the frames 110 may be classified according to the signal that they contain. For example, a frame 110 may be classified as a voiced frame, an unvoiced frame, a silent frame or a transient frame. The systems and methods disclosed herein may be applied to one or more of these kinds of frames.

The encoder 104 may use a linear predictive coding (LPC) analysis block/module 118 to perform a linear prediction analysis (e.g., LPC analysis) on a frame 110. It should be noted that the LPC analysis block/module 118 may additionally or alternatively use one or more samples from a previous frame 110.

The LPC analysis block/module 118 may produce one or more LPC or filter coefficients 116. Examples of LPC or filter coefficients 116 include line spectral frequencies (LSFs) and line spectral pairs (LSPs). The filter coefficients 116 may be provided to a residual determination block/module 112, which may be used to determine a residual signal 114. For example, a residual signal 114 may include a frame 110 of the speech signal 106 that has had the formants or the effects of the formants (e.g., coefficients) removed from the speech signal 106. The residual signal 114 may be provided to a peak search block/module 120 and/or a segmentation block/module 128.

The peak search block/module 120 may search for peaks in the residual signal 114. In other words, the encoder 104 may search for peaks (e.g., regions of high energy) in the residual signal 114. These peaks may be identified to obtain a list or set of peaks 122 that includes one or more peak locations. Peak locations in the list or set of peaks 122 may be specified in terms of sample number and/or time, for example. More detail on obtaining the list or set of peaks 122 is given below.

The set of peaks 122 may be provided to a pitch lag determination block/module 124, segmentation block/module 128, a peak mapping block/module 146 and/or to energy estimation block/module B 150. The pitch lag determination block/module 124 may use the set of peaks 122 to determine a pitch lag 126. A "pitch lag" may be a "distance" between two successive pitch spikes in a frame 110. A pitch lag 126 may be specified in a number of samples and/or an amount of time, for example. In some configurations, the pitch lag determination block/module 124 may use the set of peaks 122 or a set of pitch lag candidates (which may be the distances between the peaks 122) to determine the pitch lag 126. For example, the pitch lag determination block/module 124 may use an averaging or smoothing algorithm to determine the pitch lag 126 from a set of candidates. Other approaches may be used. The pitch lag 126 determined by the pitch lag determination block/module 124 may be provided to an excitation synthesis block/module 140, a prototype waveform generation block/module 136, energy estimation block/module B 150 and/or may be output from the encoder 104.

The excitation synthesis block/module 140 may generate or synthesize an excitation 144 based on the pitch lag 126 and a prototype waveform 138 provided by a prototype waveform generation block/module 136. The prototype waveform generation block/module 136 may generate the prototype waveform 138 based on a spectral shape and/or the pitch lag 126.

The excitation synthesis block/module 140 may provide a set of one or more synthesized excitation peak locations 142 to the peak mapping block/module 146. The set of peaks 122 (which are the set of peaks 122 from the residual signal 114 and should not be confused with the synthesized excitation peak locations 142) may also be provided to the peak mapping block/module 146. The peak mapping block/module 146 may generate a mapping 148 based on the set of peaks 122 and the synthesized excitation peak locations 142. More specifically, the regions between peaks 122 in the residual signal 114 may be mapped to regions between peaks 142 in the synthesized excitation signal. The peak mapping may be accomplished using dynamic programming techniques known in the art. The mapping 148 may be provided to energy estimation block/module B 150.

One example of peak mapping using dynamic programming is illustrated in Listing (1). The peaks $P^E$ in a synthesized excitation signal and the peaks $P_N^3$ in a modified residual signal may be mapped using dynamic programming.

Two matrices each of 10×10 dimensions (denoted scoremat and tracemat) may be initialized to 0s. These matrices may then be filled according to the pseudo code in Listing (1). For concision, $P_N^3$ is referred to as $P^T$ and the number of peaks in $P^E$ and $P^T$ are respectively denoted by $N^E$ and $N^T$.

```
for(i=1;i<=N^E;i++) {
    for(j=1;j<=N^T;j++) {
            scoreval=1-(abs(P^T [i-1]- P^E [j-1])/( P_L));
                if(scoreval<-1) scoreval=-1;
                    scoremat[i][j]=fnd_mx(scoremat[i-1][j-
                    1]+scoreval,scoremat[i-1][j],scoremat[i][j-
                    1],&mxind);
                    tracemat[i][j]=mxind;
                    if(scoremat[i][j] > mxscore) {
                        mxscore=scoremat[i][j];
                        imx=i;jmx=j;
                    }
        }
    }
    //traceback
```

-continued

```
i=imx;j=jmx;cnt=0;
while (j>0) {
    mloc=tracemat[i][j];
    switch(mloc) {
    case 0:
            tp_sel[cnt]=truepks[i-1];
            sp_sel[cnt]=synpks[j-1];
            i=i-1;
            if(i<1) i=1;
            j=j-1;
            break;
    case 1:
            tp_sel[cnt]=truepks[i-1];
            sp_sel[cnt]=0;
            i=i-1;
            if(i<1) i=1;
            break;
    case 2:
            tp_sel[cnt]=0;
            sp_sel[cnt]=synpks[j-1];
            j=j-1;
            break;
    }
    cnt++;
}
```

The mapping matrix mapped_pks[i] is then determined by:

Listing (1)

```
for(i=0;i<N^E;i++) {
        mapped_pks[i]=0;
        for(j=0;j<cnt;j++) if(sp_sel[j]==P^E [i]) break;
        if(j!=cnt) mapped_pks[i]=tp_sel[j];
}
for(i=1;i<N^E;i++) {
    if(mapped_pks[i]==mapped_pks[i-1]) {
        mapped_pks[i]=0;
    }
}
```

The segmentation block/module 128 may segment the residual signal 114 to produce a segmented residual signal 130. For example, the segmentation block/module 128 may use the set of peak locations 122 in order to segment the residual signal 114, such that each segment includes only one peak. In other words, each segment in the segmented residual signal 130 may include only one peak. The segmented residual signal 130 may be provided to energy estimation block/module A 132.

Energy estimation block/module A 132 may determine or estimate a first set of pitch cycle energy parameters 134. For example, energy estimation block/module A 132 may estimate the first set of pitch cycle energy parameters 134 based on one or more regions of the frame 110 between two consecutive peak locations. For instance, energy estimation block/module A 132 may use the segmented residual signal 130 to estimate the first set of pitch cycle energy parameters 134. For example, if the segmentation indicates that the first pitch cycle is between samples S1 to S2, then the energy of that pitch cycle may be calculated by the sum of squares of all samples between S1 and S2. This may be done for each pitch cycle as determined by a segmentation algorithm. The first set of pitch cycle energy parameters 134 may be provided to energy estimation block/module B 150.

The excitation 144, the mapping 148, the pitch lag 126, the set of peaks 122, the first set of pitch cycle energy parameters 134 and/or the filter coefficients 116 may be provided to energy estimation block/module B 150. Energy estimation block/module B 150 may determine (e.g., estimate, calculate, etc.) a second set of pitch cycle energy parameters (e.g., gains, scaling factors, etc.) 152 based on the excitation 144, the mapping 148, the pitch lag 126, the set of peaks 122, the first set of pitch cycle energy parameters 134 and/or the filter coefficients 116. In some configurations, the second set of pitch cycle energy parameters 152 may be provided to a TX/RX block/module 160 and/or to a decoder 162.

The encoder 104 may send, output or provide a pitch lag 126, filter coefficients 116 and/or pitch cycle energy parameters 152. In one configuration, an encoded frame may be decoded using the pitch lag 126, the filter coefficients 116 and/or the pitch cycle energy parameters 152 in order to produce a decoded speech signal. The pitch lag 126, the filter coefficients 116 and/or the pitch cycle energy parameters 152 may be transmitted to another device, stored and/or decoded.

In one configuration, electronic device A 102 includes a TX/RX block/module 160. In this configuration, several parameters may be provided to the TX/RX block/module 160. For example, the pitch lag 126, the filter coefficients 116 and/or the pitch cycle energy parameters 152 may be provided to the TX/RX block/module 160. The TX/RX block/module 160 may format the pitch lag 126, the filter coefficients 116 and/or the pitch cycle energy parameters 152 into a format suitable for transmission. For example, the TX/RX block/module 160 may encode (not to be confused with frame encoding provided by the encoder 104), modulate, scale (e.g., amplify) and/or otherwise format the pitch lag 126, the filter coefficients 116 and/or the pitch cycle energy parameters 152 as one or more messages 166. The TX/RX block/module 160 may transmit the one or more messages 166 to another device, such as electronic device B 168. The one or more messages 166 may be transmitted using a wireless and/or wired connection or link. In some configurations, the one or more messages 166 may be relayed by satellite, base station, routers, switches and/or other devices or mediums to electronic device B 168.

Electronic device B 168 may receive the one or more messages 166 transmitted by electronic device A 102 using a TX/RX block/module 170. The TX/RX block/module 170 may decode (not to be confused with speech signal decoding), demodulate and/or otherwise deformat the one or more received messages 166 to produce speech signal information 172. The speech signal information 172 may comprise, for example, a pitch lag, filter coefficients and/or pitch cycle energy parameters. The speech signal information 172 may be provided to a decoder 174 (e.g., an LPC decoder) that may produce (e.g., decode) a decoded or synthesized speech signal 176. The decoder 174 may include a scaling and LPC synthesis block/module 178. The scaling and LPC synthesis block/module 178 may use the (received) speech signal information (e.g., filter coefficients, pitch cycle energy parameters and/or a synthesized excitation that is synthesized based on a pitch lag) to produce the synthesized speech signal 176. The synthesized speech signal 176 may be converted to an acoustic signal (e.g., output) using a transducer (e.g., speaker), stored in memory and/or transmitted to another device (e.g., Bluetooth headset).

In another configuration, the pitch lag 126, the filter coefficients 116 and/or the pitch cycle energy parameters 152 may be provided to a decoder 162 (on electronic device A 102). The decoder 162 may use the pitch lag 126, the filter coefficients 116 and/or the pitch cycle energy parameters 152 to produce a decoded or synthesized speech signal 164. More specifically, the decoder 162 may include a scaling and LPC synthesis block/module 154. The scaling and LPC synthesis block/module 154 may use the filter coefficients 116, the pitch cycle energy parameters 152 and/or a synthesized excitation (that is synthesized based on the pitch lag 126) to produce the synthesized speech signal 164. The synthesized speech signal 164 may be output using a speaker, stored in memory and/or transmitted to another device, for example. For instance, electronic device A 102 may be a digital voice recorder that encodes and stores speech signals 106 in memory, which may then be decoded to produce a synthesized speech signal 164. The synthesized speech signal 164 may then be converted to an acoustic signal (e.g., output) using a transducer (e.g., speaker). The decoder 162 on electronic device A 102 and the decoder 174 on electronic device B 168 may perform similar functions.

Several points should be noted. The decoder 162 illustrated as included in electronic device A 102 may or may not be included and/or used depending on the configuration. Furthermore, electronic device B 168 may or may not be used in conjunction with electronic device A 102. Furthermore, although several parameters or kinds of information 126, 116, 152 are illustrated as being provided to the TX/RX block/module 160 and/or to the decoder 162, these parameters or kinds of information 126, 116, 152 may or may not be stored in memory before being sent to the TX/RX block/module 160 and/or the decoder 162.

Figure 2:
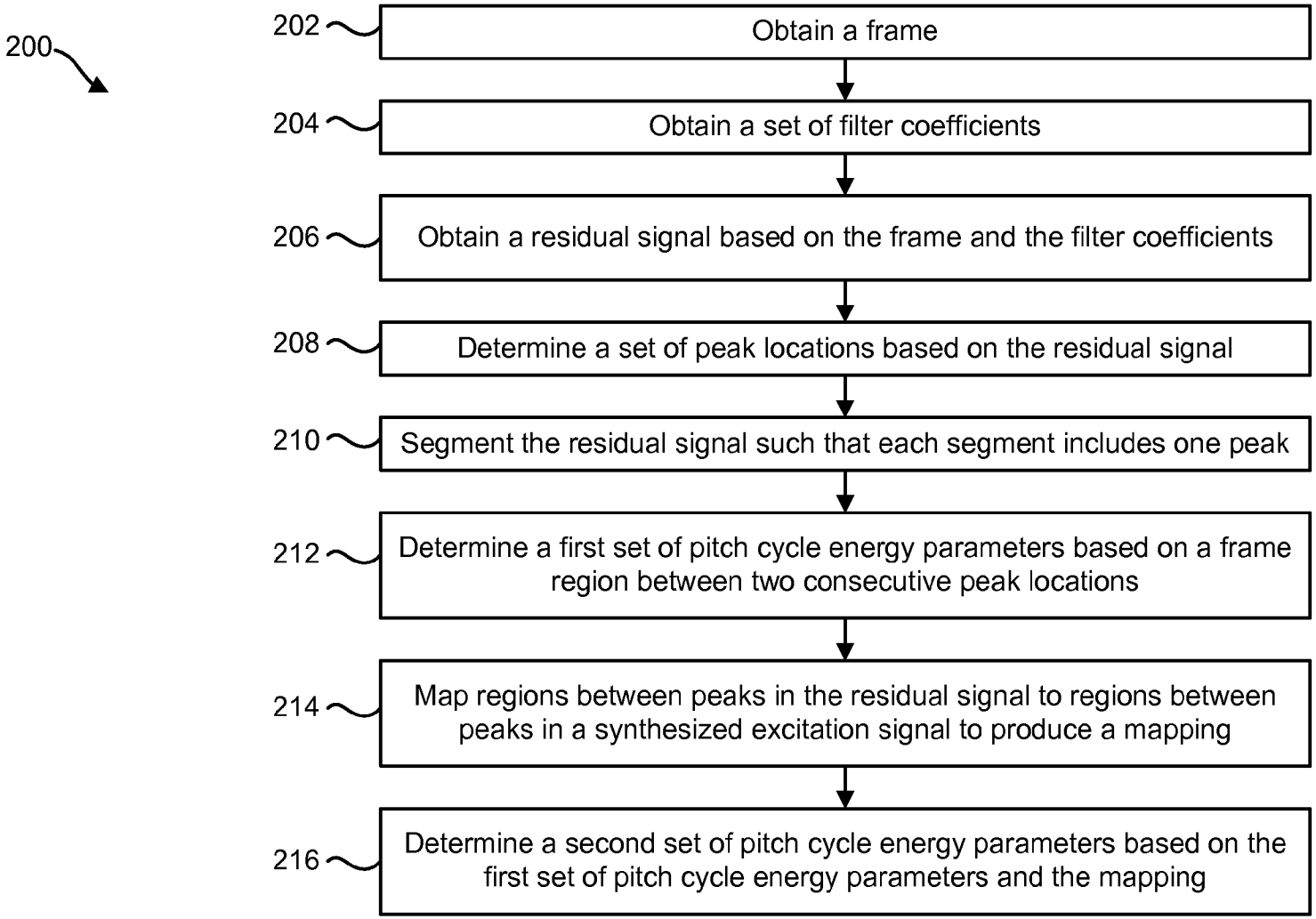
FIG. 2 is a flow diagram illustrating one configuration of a method for determining pitch cycle energy.

FIG. 2 is a flow diagram illustrating one configuration of a method 200 for determining pitch cycle energy. For example, an electronic device 102 may perform the method 200 illustrated in FIG. 2 in order to estimate a set of pitch cycle energy parameters. An electronic device 102 may obtain 202 a frame 110. In one configuration, the electronic device 102 may obtain an electronic speech signal 106 by capturing an acoustic speech signal using a microphone. Additionally or alternatively, the electronic device 102 may receive the speech signal 106 from another device. The electronic device 102 may then format (e.g., divide, segment, etc.) the speech signal 106 into one or more frames 110. One example of a frame 110 may include a certain number of samples or a given amount of time (e.g., 10-20 milliseconds) of the speech signal 106.

The electronic device 102 may obtain 204 a set of filter (e.g., LPC) coefficients 116. For example, the electronic device 102 may perform an LPC analysis on the frame 110 in order to obtain 204 the set of filter coefficients 116. The set of filter coefficients 116 may be, for instance, line spectral frequencies (LSFs) or line spectral pairs (LSPs). In one configuration, the electronic device 102 may use a look-ahead buffer and a buffer containing at least one sample of the speech signal 106 prior to the current frame 110 to obtain the LPC or filter coefficients 116.

The electronic device 102 may obtain 206 a residual signal 114 based on the frame 110 and the filter coefficients 116. For example, the electronic device 102 may remove the effects of the LPC or filter coefficients 116 (e.g., formants) from the current frame 110 to obtain 206 the residual signal 114.

The electronic device 102 may determine 208 a set of peak locations 122 based on the residual signal 114. For example, the electronic device 102 may search the LPC residual signal 114 to determine 208 the set of peak locations 122. A peak location may be described in terms of time and/or sample number, for example.

The electronic device 102 may segment 210 the residual signal 114 such that each segment contains one peak. For example, the electronic device 102 may use the set of peak locations 122 in order to form one or more groups of samples from the residual signal 114, where each group of samples includes a peak location. In one configuration, for example, a segment may start from just before a first peak to samples just before a second peak. This may ensure that only one peak is selected. Thus, the starting and/or ending points of a segment may occur at a fixed number of samples ahead of a peak or a local minima in the amplitude just ahead of the peak. Thus, the electronic device 102 may segment 210 the residual signal 114 to produce a segmented residual signal 130.

The electronic device 102 may determine 212 (e.g., estimate) a first set of pitch cycle energy parameters 134. The first set of pitch cycle energy parameters 134 may be determined based on a frame region between two consecutive (e.g., neighboring) peak locations. For instance, the electronic device 102 may use the segmented residual signal 130 to estimate the first set of pitch cycle energy parameters 134.

The electronic device 102 may map 214 regions between peaks 122 in the residual signal to regions between peaks 142 in the synthesized excitation signal. For example, mapping 214 regions between the residual signal peaks 122 to regions between the synthesized excitation signal peaks 142 may produce a mapping 148. The synthesized excitation signal may be obtained (e.g., synthesized) by the electronic device 102 based on a prototype waveform 138 and/or a pitch lag 126.

The electronic device 102 may determine 216 (e.g., calculate, estimate, etc.) a second set of pitch cycle energy parameters 152 based on the first set of pitch cycle energy parameters 134 and the mapping 148. For example, the second set of pitch cycle energy parameters may be determined 216 as follows. Let the first set of energies (e.g., first set of pitch cycle energy parameters) be $E_1, E_2, E_3, \ldots, E_{N-1}$ corresponding to the peak locations in the residuals $P_1, P_2, P_3, \ldots, P_N$. In other words, $$E_1 = \sum_{j=P_1}^{P_2} |r(j)|^2,$$

where r(j) is the residual. Let the peak locations $P_1$, $P_2$, $P_3, \ldots, P_N$ be mapped to $P'_1, P'_2, P'_3, \ldots, P'_N$ locations in the excitation signal. The second set of target energies (e.g., second set of pitch cycle energy parameters 152) $E'_1$, $E'_2$, $E'_3, \ldots, E'_{N-1}$ may be derived by $$E'_k = E_k \frac{P'_{k+1} - P'_k}{P_{k+1} - P_k},$$

where $1 \le k \le N-1$.

The electronic device 102 may store, send (e.g., transmit, provide) and/or use the second set of pitch cycle energy parameters 152. For example, the electronic device 102 may store the second set of pitch cycle energy parameters 152 in memory. Additionally or alternatively, the electronic device 102 may transmit the second set of pitch cycle energy parameters 152 to another electronic device. Additionally or alternatively, the electronic device 102 may use the second set of pitch cycle energy parameters 152 to decode or synthesize a speech signal, for example.

Figure 3:
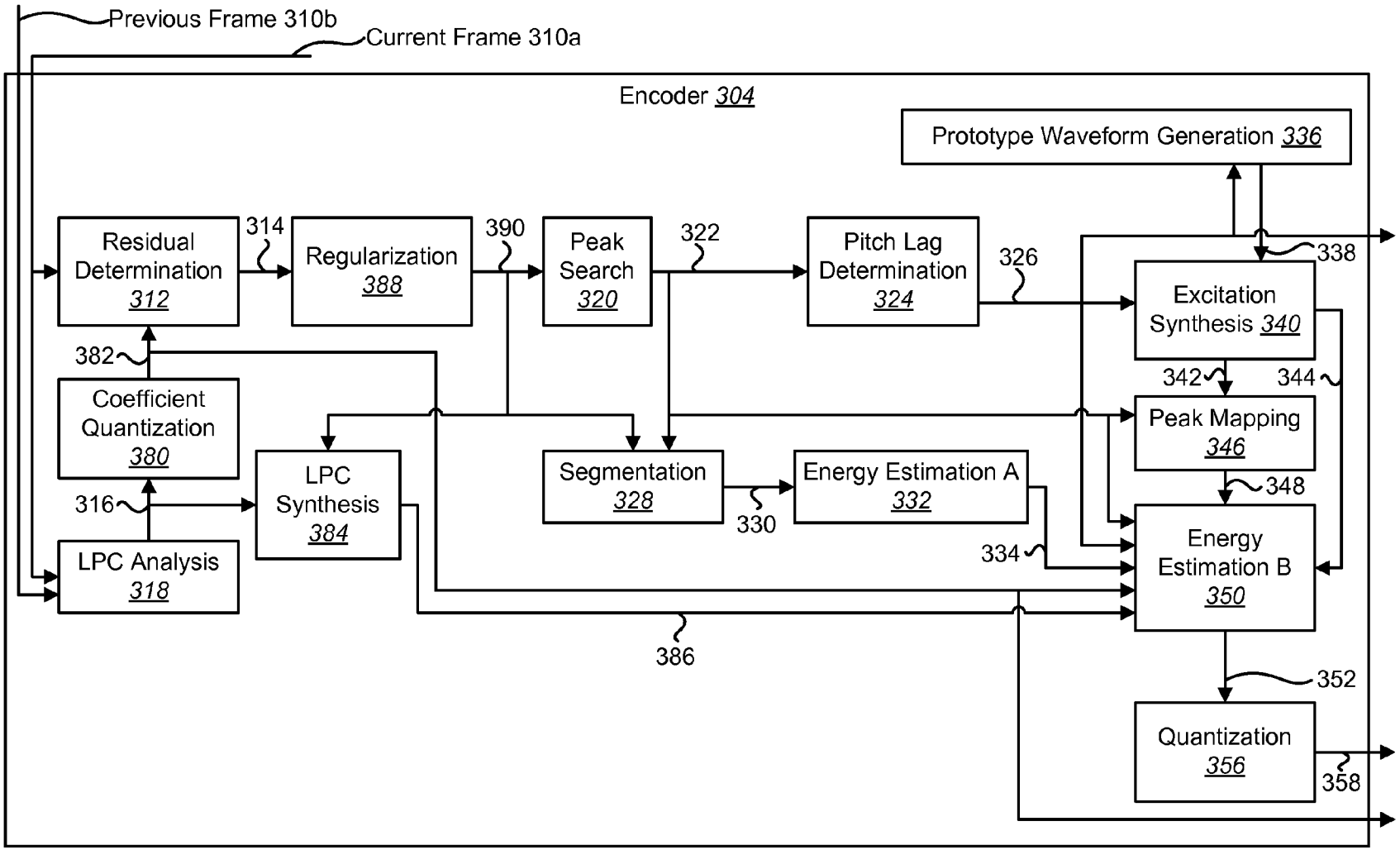
FIG. 3 is a block diagram illustrating one configuration of an encoder in which systems and methods for determining pitch cycle energy may be implemented.

FIG. 3 is a block diagram illustrating one configuration of an encoder 304 in which systems and methods for determining pitch cycle energy may be implemented. One example of the encoder 304 is a Linear Predictive Coding (LPC) encoder. The encoder 304 may be used by an electronic device 102 to encode a speech (or audio) signal 106. For instance, the encoder 304 encodes frames 310 of a speech signal 106 into a "compressed" format by estimating or generating a set of parameters that may be used to synthesize or decode the speech signal 106. In one configuration, such parameters may represent estimates of pitch (e.g., frequency), amplitude and formants (e.g., resonances) that can be used to synthesize the speech signal 106.

The speech signal 106 may be formatted (e.g., divided, segmented, etc.) into one or more frames 310 (e.g., a sequence of frames 310). For instance, a frame 310 may include a particular number of speech signal 106 samples and/or include an amount of time (e.g., 10-20 milliseconds) of the speech signal 106. The speech signal 106 in the frames 310 may vary in terms of energy. The systems and methods disclosed herein may be used to estimate "target" pitch cycle energy parameters, which may be used to scale an excitation signal to match the energy from the speech signal 106.

The encoder 304 may use a linear predictive coding (LPC) analysis block/module 318 to perform a linear prediction analysis (e.g., LPC analysis) on a current frame 310*a*. The LPC analysis block/module 318 may also use one or more samples from a previous frame 310*b* (of the speech signal 106).

The LPC analysis block/module 318 may produce one or more LPC or filter coefficients 316. Examples of LPC or filter coefficients 316 include line spectral frequencies (LSFs) and line spectral pairs (LSPs). The filter coefficients 316 may be provided to a coefficient quantization block/module 380 and an LPC synthesis block/module 384.

The coefficient quantization block/module 380 may quantize the filter coefficients 316 to produce quantized filter coefficients 382. The quantized filter coefficients 382 may be provided to a residual determination block/module 312 and energy estimation block/module B 350 and/or may be provided or sent from the encoder 304.

The quantized filter coefficients 382 and one or more samples from the current frame 310*a* may be used by the residual determination block/module 312 to determine a residual signal 314. For example, a residual signal 314 may include a current frame 310*a* of the speech signal 106 that has had the formants or the effects of the formants (e.g., coefficients) removed from the speech signal 106. The residual signal 314 may be provided to a regularization block/module 388.

The regularization block/module 388 may regularize the residual signal 314, resulting in a modified (e.g., regularized) residual signal 390. One example of regularization is described in detail in section 4.11.6 of 3GPP2 document C.S0014D titled "Enhanced Variable Rate Codec, Speech Service Options 3, 68, 70, and 73 for Wideband Spread Spectrum Digital Systems." Basically, regularization may move around the pitch pulses in the current frame to line them up with a smoothly evolving pitch coutour. The modified residual signal 390 may be provided to a peak search block/module 320, a segmentation block/module 328 and/or to an LPC synthesis block/module 384. The LPC synthesis block/module 384 may produce (e.g., synthesize) a modified speech signal 386, which may be provided to energy estimation block/module B 350. The modified speech signal 386 may be referred to as "modified" because it is a speech signal derived from the regularized residual and is therefore not the original speech, but a modified version of it.

The peak search block/module 320 may search for peaks in the modified residual signal 390. In other words, the transient encoder 304 may search for peaks (e.g., regions of high energy) in the modified residual signal 390. These peaks may be identified to obtain a list or set of peaks 322 that includes one or more peak locations. Peak locations in the list or set of peaks 322 may be specified in terms of sample number and/or time, for example.

The set of peaks 322 may be provided to the pitch lag determination block/module 324, peak mapping block/module 346, segmentation block/module 328 and/or energy estimation block/module B 350. The pitch lag determination block/module 324 may use the set of peaks 322 to determine a pitch lag 326. A "pitch lag" may be a "distance" between two successive pitch spikes in a current frame 310*a*. A pitch lag 326 may be specified in a number of samples and/or an amount of time, for example. In some configurations, the pitch lag determination block/module 324 may use the set of peaks 322 or a set of pitch lag candidates (which may be the distances between the peaks 322) to determine the pitch lag 326. For example, the pitch lag determination block/module 324 may use an averaging or smoothing algorithm to determine the pitch lag 326 from a set of candidates. Other approaches may be used. The pitch lag 326 determined by the pitch lag determination block/module 324 may be provided to the excitation synthesis block/module 340, to energy estimation block/module B 350, to a prototype waveform generation block/module 336 and/or may be provided or sent from the encoder 304.

The excitation synthesis block/module 340 may generate or synthesize an excitation 344 based on the pitch lag 326 and/or a prototype waveform 338 provided by the prototype waveform generation block/module 336. The prototype waveform generation block/module 336 may generate the prototype waveform 338 based on a spectral shape and/or the pitch lag 326.

The excitation synthesis block/module 340 may provide a set of one or more synthesized excitation peak locations 342 to the peak mapping block/module 346. The set of peaks 322 (which are the set of peaks 322 from the residual signal 314 and should not be confused with the synthesized excitation peak locations 342) may also be provided to the peak mapping block/module 346. The peak mapping block/module 346 may generate a mapping 348 based on the set of peaks 322 and the synthesized excitation peak locations 342. More specifically, the regions between peaks 322 in the residual signal may be mapped to regions between peaks 342 in the synthesized excitation signal. The mapping 348 may be provided to energy estimation block/module B 350.

The segmentation block/module 328 may segment the modified residual signal 390 to produce a segmented residual signal 330. For example, the segmentation block/module 328 may use the set of peak locations 322 in order to segment the residual signal 314, such that each segment includes only one peak. In other words, each segment in the segmented residual signal 330 may include only one peak. The segmented residual signal 330 may be provided to energy estimation block/module A 332.

Energy estimation block/module A 332 may determine or estimate a first set of pitch cycle energy parameters 334. For example, energy estimation block/module A 332 may estimate the first set of pitch cycle energy parameters 334 based on one or more regions of the current frame 310*a* between two consecutive peak locations. For instance, energy estimation block/module A 332 may use the segmented residual signal 330 to estimate the first set of pitch cycle energy parameters 334. The first set of pitch cycle energy parameters 334 may be provided to energy estimation block/module B 350. It should be noted that a pitch cycle energy parameter (in the first set 334) may be determined at each pitch cycle.

The excitation 344, the mapping 348, the set of peaks 322, the pitch lag 326, the first set of pitch cycle energy parameters 334, the quantized filter coefficients 382 and/or the modified speech signal 386 may be provided to energy estimation block/module B 350. Energy estimation block/module B 350 may determine (e.g., estimate, calculate, etc.) a second set of pitch cycle energy parameters (e.g., gains, scaling factors, etc.) 352 based on excitation 344, the mapping 348, the set of peaks 322, the pitch lag 326, the first set of pitch cycle energy parameters 334, the quantized filter coefficients 382 and/or the modified speech signal 386. In some configurations, the second set of pitch cycle energy parameters 352 may be provided to a quantization block/module 356 that quantizes the second set of pitch cycle energy parameters 352 to produce a set of quantized pitch cycle energy parameters 358. It should be noted that a pitch cycle energy parameter (in the second set 352) may be determined at each pitch cycle.

The encoder 304 may send, output or provide a pitch lag 326, quantized filter coefficients 382 and/or quantized pitch cycle energy parameters 358. In one configuration, an encoded frame may be decoded using the pitch lag 326, the quantized filter coefficients 382 and/or the quantized pitch cycle energy parameters 358 in order to produce a decoded speech signal. The pitch lag 326, the quantized filter coefficients 382 and/or the quantized pitch cycle energy parameters 358 may be transmitted to another device, stored and/or decoded.

Figure 4:
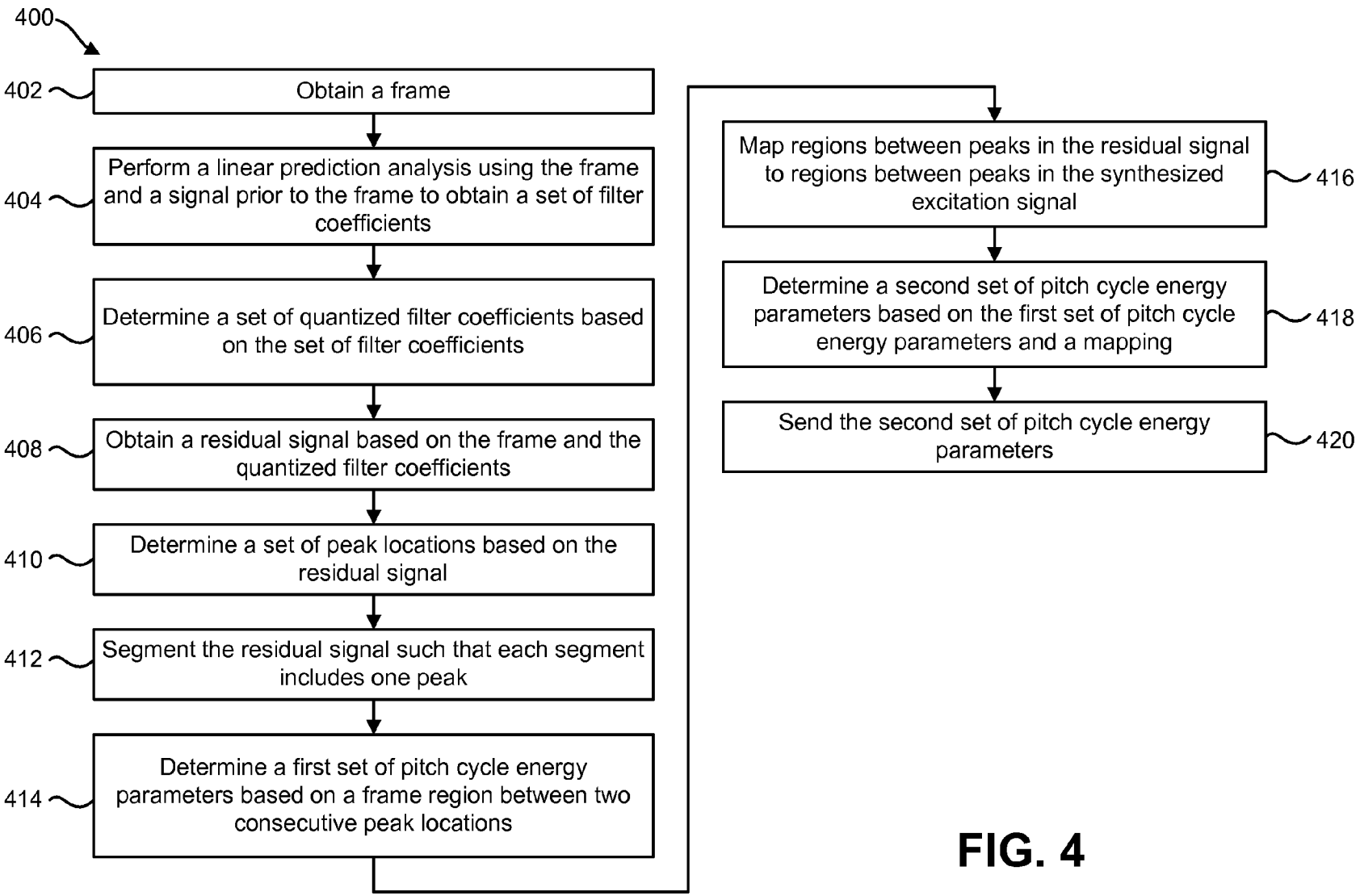
FIG. 4 is a flow diagram illustrating a more specific configuration of a method for determining pitch cycle energy.

FIG. 4 is a flow diagram illustrating a more specific configuration of a method 400 for determining pitch cycle energy. For example, an electronic device may perform the method 400 illustrated in FIG. 4 in order to estimate or calculate a set of pitch cycle energy parameters. An electronic device may obtain 402 a frame 310. In one configuration, the electronic device may obtain an electronic speech signal by capturing an acoustic speech signal using a microphone. Additionally or alternatively, the electronic device may receive the speech signal from another device. The electronic device may then format (e.g., divide, segment, etc.) the speech signal into one or more frames 310. One example of a frame 310 may include a certain number of samples or a given amount of time (e.g., 10-20 milliseconds) of the speech signal.

The electronic device may perform 404 a linear prediction analysis using the (current) frame 310*a* and a signal prior to the (current) frame 310*a* (e.g., one or more samples from a previous frame 310*b*) to obtain a set of filter (e.g., LPC) coefficients 316. For example, the electronic device may use a look-ahead buffer and a buffer containing at least one sample of the speech signal from the previous frame 310*b* to obtain the filter coefficients 316.

The electronic device may determine 406 a set of quantized filter (e.g., LPC) coefficients 382 based on the set of filter coefficients 316. For example, the electronic device may quantize the set of filter coefficients 316 to determine 406 the set of quantized filter coefficients 382.

The electronic device may obtain 408 a residual signal 314 based on the (current) frame 310*a* and the quantized filter coefficients 382. For example, the electronic device may remove the effects of the filter coefficients 316 (or quantized filter coefficients 382) from the current frame 310*a* to obtain 408 the residual signal 314.

The electronic device may determine 410 a set of peak locations 322 based on the residual signal 314 (or modified residual signal 390). For example, the electronic device may search the LPC residual signal 314 to determine the set of peak locations 322. A peak location may be described in terms of time and/or sample number, for example.

In one configuration, the electronic device may determine 410 the set of peak locations as follows. The electronic device may calculate an envelope signal based on the absolute value of samples of the (LPC) residual signal 314 (or modified residual signal 390) and a predetermined window signal. The electronic device may then calculate a first gradient signal based on a difference between the envelope signal and a time-shifted version of the envelope signal. The electronic device may calculate a second gradient signal based on a difference between the first gradient signal and a time-shifted version of the first gradient signal. The electronic device may then select a first set of location indices where a second gradient signal value falls below a predetermined negative (first) threshold. The electronic device may also determine a second set of location indices from the first set of location indices by eliminating location indices where an envelope value falls below a predetermined (second) threshold relative to the largest value in the envelope. Additionally, the electronic device may determine a third set of location indices from the second set of location indices by eliminating location indices that are not a pre-determined difference threshold with respect to neighboring location indices. The location indices (e.g., the first, second and/or third set) may correspond to the location of the determined set of peaks 322.

The electronic device may segment 412 the residual signal 314 (or modified residual signal 390) such that each segment includes one peak. For example, the electronic device may use the set of peak locations 322 in order to form one or more groups of samples from the residual signal 314 (or modified residual signal 390), where each group of samples includes a peak location. In other words, the electronic device may segment 412 the residual signal 314 to produce a segmented residual signal 330.

The electronic device may determine 414 (e.g., estimate) a first set of pitch cycle energy parameters 334. The first set of pitch cycle energy parameters 334 may be determined based on a frame region between two consecutive peak locations. For instance, the electronic device may use the segmented residual signal 330 to estimate the first set of pitch cycle energy parameters 334.

The electronic device may map 416 regions between peaks 322 in the residual signal to regions between peaks 342 in the synthesized excitation signal. For example, mapping 416 regions between the residual signal peaks 322 to regions between the synthesized excitation signal peaks 342 may produce a mapping 348.

The electronic device may determine 418 (e.g., calculate, estimate, etc.) a second set of pitch cycle energy parameters 352 based on the first set of pitch cycle energy parameters 334 and the mapping 348. In some configurations, the electronic device may quantize the second set of pitch cycle energy parameters 352.

The electronic device may send (e.g., transmit, provide) 420 the second set of pitch cycle energy parameters 352 (or quantized pitch cycle energy parameters 358). For example, the electronic device may transmit the second set of pitch cycle energy parameters 352 (or quantized pitch cycle energy parameters 358) to another electronic device. Additionally or alternatively, the electronic device may send the second set of pitch cycle energy parameters 352 (or quantized pitch cycle energy parameters 358) to a decoder in order to decode or synthesize a speech signal, for example. In some configurations, the electronic device may additionally or alternatively store the second set of pitch cycle energy parameters 352 in memory. In some configurations, the electronic device may also send a pitch lag 326 and/or the quantized filter coefficients 382 to a decoder (on the same or different electronic device) and/or to a storage device.

Figure 5:
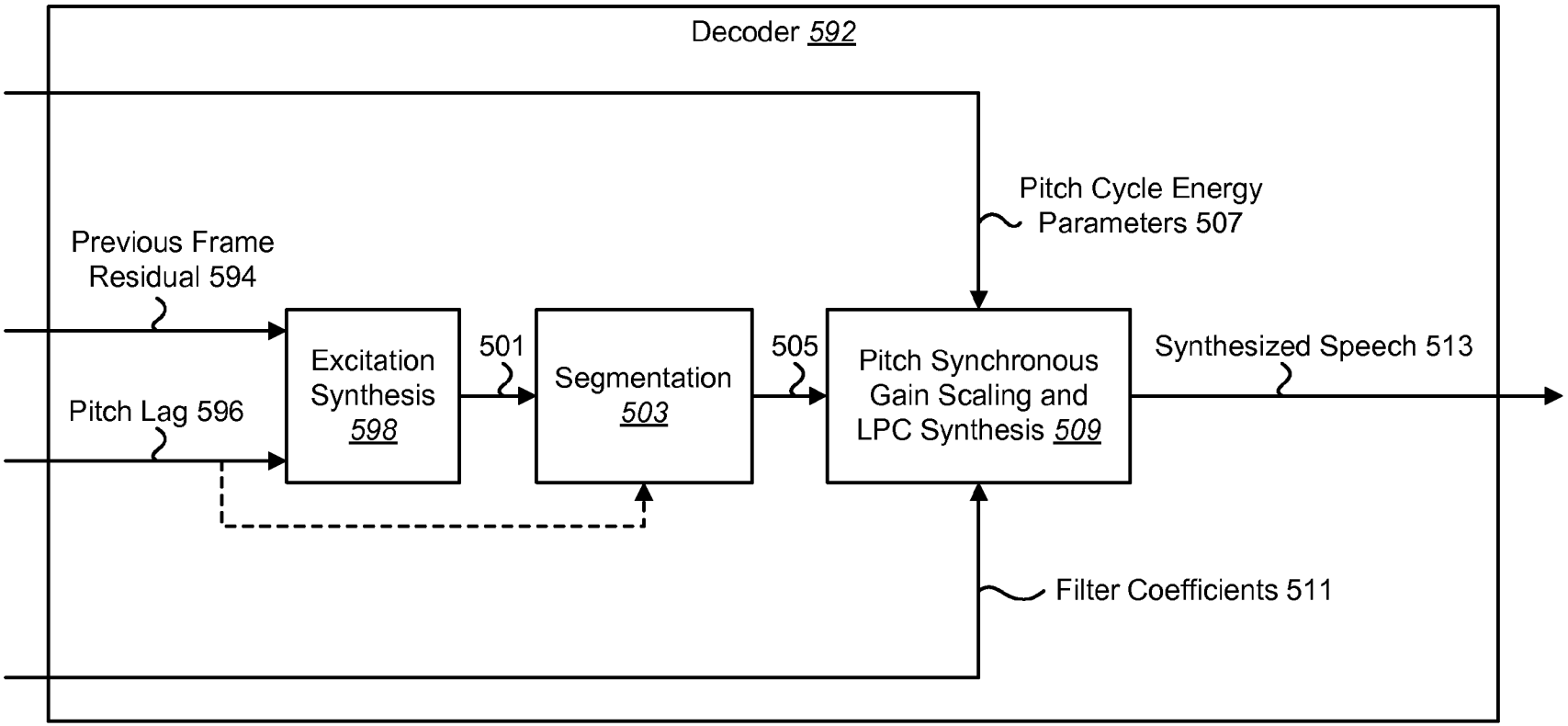
FIG. 5 is a block diagram illustrating one configuration of a decoder in which systems and methods for scaling an excitation signal may be implemented.

FIG. 5 is a block diagram illustrating one configuration of a decoder 592 in which systems and methods for scaling an excitation signal may be implemented. The decoder 592 may include an excitation synthesis block/module 598, a segmentation block/module 503 and/or a pitch synchronous gain scaling and LPC synthesis block/module 509. One example of the decoder 592 is an LPC decoder. For instance, the decoder 592 may be a decoder 162, 174 as illustrated in FIG. 1.

The decoder 592 may obtain one or more pitch cycle energy parameters 507, a previous frame residual 594 (which may be derived from a previously decoded frame), a pitch lag 596 and filter coefficients 511. For example, an encoder 104 may provide the pitch cycle energy parameters 507, the pitch lag 596 and/or filter coefficients 511. In one configuration, this information 507, 596, 511 may originate from an encoder 104 that is on the same electronic device as the decoder 592. For instance, the decoder 592 may receive the information 507, 596, 511 directly from an encoder 104 or may retrieve it from memory. In another configuration, the information 507, 596, 511 may originate from an encoder 104 that is on a different electronic device from the decoder 592. For instance, the decoder 592 may obtain the information 507, 596, 511 from a receiver 170 that has received it from another electronic device 102.

In some configurations, the pitch cycle energy parameters 507, the pitch lag 596 and/or filter coefficients 511 may be received as parameters. More specifically, the decoder 592 may receive a parameter representing pitch cycle energy parameters 507, a pitch lag parameter 596 and/or a filter coefficients parameter 511. For instance, each type of this information 507, 596, 511 may be represented using a number of bits. In one configuration, these bits may be received in a packet. The bits may be unpacked, interpreted, de-formatted and/or decoded by an electronic device and/or the decoder 592 such that the decoder 592 may use the information 507, 596, 511. In one configuration, bits may be allocated for the information 507, 596, 511 as set forth in Table (1).

TABLE (1)

| Parameter | Number of Bits |
|---|---|
| Filter coefficients 511 (e.g., LSPs or LSFs) | 18 |
| Pitch Lag 596 | 7 |
| Pitch Cycle Energy Parameters 507 | 8 |

It should be noted that these parameters 511, 596, 507 may be sent in addition to or alternatively from other parameters or information.

The excitation synthesis block/module 598 may synthesize an excitation 501 based on a pitch lag 596 and/or a previous frame residual 594. The synthesized excitation signal 501 may be provided to the segmentation block/module 503. The segmentation block/module 503 may segment the excitation 501 to produce a segmented excitation 505. In some configurations, the segmentation block/module 503 may segment the excitation 501 such that each segment (of the segmented excitation 505) contains only one peak. In other configurations, the segmentation block/module 503 may segment the excitation 501 based on the pitch lag 596. When the excitation 501 is segmented based on the pitch lag 596, each of the segments (of the segmented excitation 505) may include one or more peaks.

The segmented excitation 505 may be provided to the pitch synchronous gain scaling and LPC synthesis block/module 509. The pitch synchronous gain scaling and LPC synthesis block/module 509 may use the segmented excitation 505, the pitch cycle energy parameters 507 and/or the filter coefficients 511 to produce a synthesized or decoded speech signal 513. One example of a pitch synchronous gain scaling and LPC synthesis block/module 509 is described in connection with FIG. 6 below. The synthesized speech signal 513 may be stored in memory, may be output using a speaker and/or may be transmitted to another electronic device.

Figure 6:
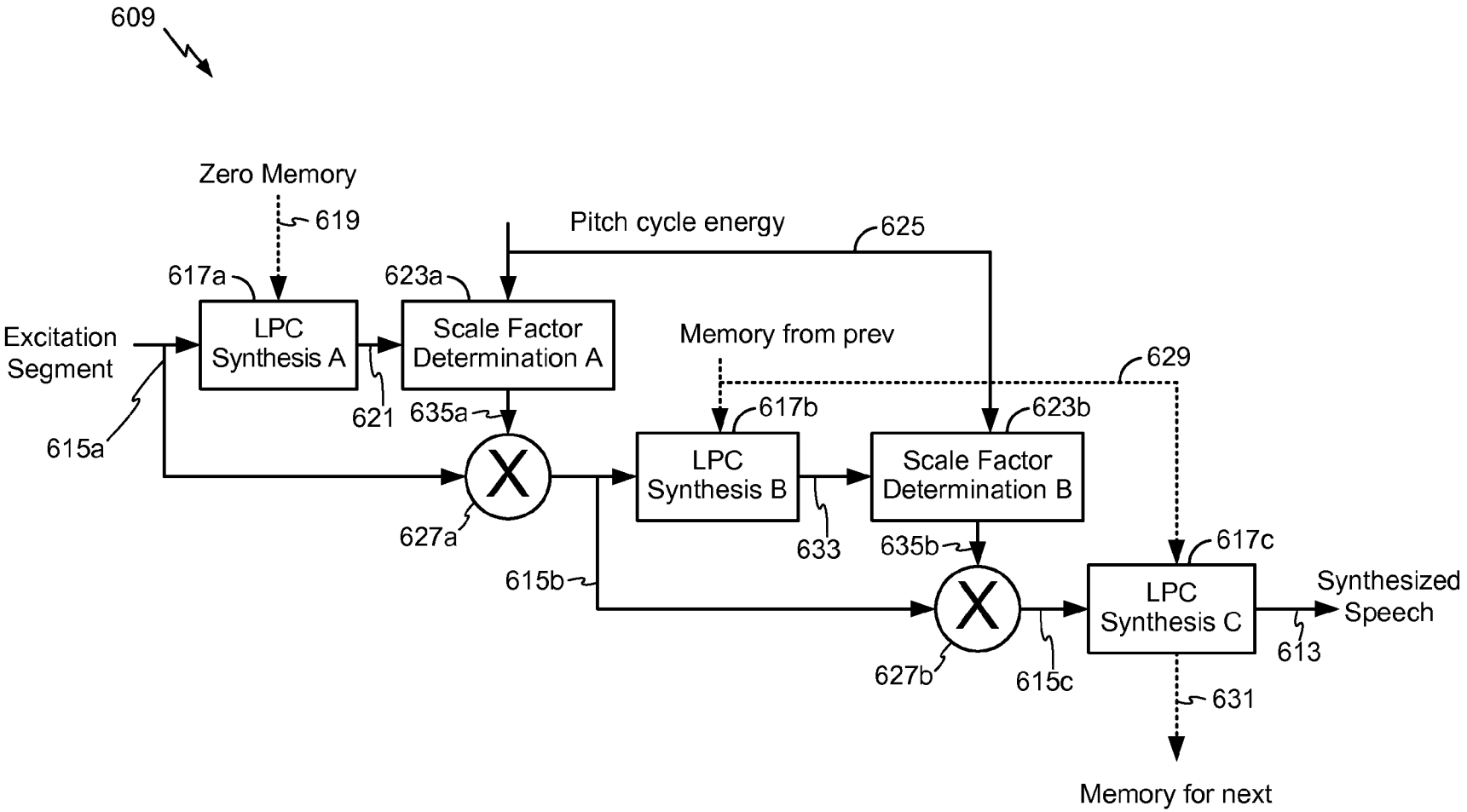
FIG. 6 is a block diagram illustrating one configuration of a pitch synchronous gain scaling and LPC synthesis block/module.

FIG. 6 is a block diagram illustrating one configuration of a pitch synchronous gain scaling and LPC synthesis block/module 609. The pitch synchronous gain scaling and LPC synthesis block/module 609 illustrated in FIG. 6 may be one example of a pitch synchronous gain scaling and LPC synthesis block/module 509 shown in FIG. 5. As illustrated in FIG. 6, a pitch synchronous gain scaling and LPC synthesis block/module 609 may include one or more LPC synthesis filters 617*a-c*, one or more scale factor determination blocks/modules 623*a-b* and/or one or more multipliers 627*a-b*.

The pitch synchronous gain scaling and LPC synthesis block/module 609 may be used to scale an excitation signal and synthesize speech at a decoder (and/or at an encoder in some configurations). The pitch synchronous gain scaling and LPC synthesis block/module 609 may obtain or receive an excitation segment (e.g., excitation signal segment) 615*a*, a pitch cycle energy parameter 625 and one or more filter (e.g., LPC) coefficients. In one configuration, the excitation segment 615*a* may be a segment of an excitation signal that includes a single pitch cycle. The pitch synchronous gain scaling and LPC synthesis block/module 609 may scale the excitation segment 615*a* and synthesize (e.g., decode) speech based on the pitch cycle energy parameter 625 and the one or more filter coefficients. For example, the LPC coefficients may be inputs to the synthesis filter. These coefficients may be used in an autoregressive synthesis filter to generate the synthesized speech. The pitch synchronous gain scaling and LPC synthesis block/module 609 may attempt to scale the excitation segment 615*a* to the level of original speech while synthesizing it. In some configurations, these procedures may also be followed on the same electronic device that encoded the speech signal in order to maintain some memory or a copy of the synthesized speech 613 at the encoder for future analysis or synthesis.

The systems and methods described herein may be beneficially applied by having the decoded signal match the energy level of original speech. For instance, matching the decoded speech energy level with the original speech may be beneficial when waveform reconstruction is not used. For example, in model-based reconstruction, fine scaling of the excitation to match an original speech level may be beneficial.

As described above, an encoder may determine the energy on every pitch cycle and pass that information to a decoder. For steady voice segments, the energy may remain approximately constant. In other words, from cycle to cycle, the energy may remain fairly constant for steady voice segments. However, there may be other transient segments where the energy may not be a constant. Thus, that contour may be transmitted to the decoder and the energies that are transmitted may be fixed synchronous, which may mean that one unique energy value per pitch cycle is sent from the encoder to the decoder. Each energy value represents the energy of original speech for a pitch cycle. For instance, if there is a set of p pitch cycles in a frame, p energy values may be transmitted (per frame).

The block diagram illustrated in FIG. 6 illustrates the scaling and synthesis that may be done for a pitch cycle or segment (e.g., the $k^{th}$ cycle or segment, where $1 \le k \le p$). An excitation segment 615*a* (e.g., a cycle of an excitation signal) may be input into LPC synthesis filter A 617*a* (e.g., LPC synthesis filter A 617*a*). Initially, the memory 619 of LPC synthesis filter A 617*a* may be zero. For example, the memory 619 may be "zeroed." LPC synthesis filter A 617*a* may produce a first synthesized segment 621 (e.g., a "first cut" speech signal estimate prior to scaling, which may be denoted $x_1(i)$, where i is a sample or index number within the $k^{th}$ synthesized segment).

Scale factor determination block/module A 623*a* may use the first synthesized segment (e.g., $x_1(i)$) 621 in addition to the (target) pitch cycle energy 625 for the current segment (e.g., $E_k$) in order to estimate a first scaling factor (e.g., $S_k$) 635*a*. The (synthesized) excitation segment 615*a* may be multiplied by the first scaling factor 635*a* to produce a first scaled excitation segment 615*b*.

In the configuration illustrated in FIG. 6, the pitch synchronous scaling and LPC synthesis block/module 609 is shown as implemented in two stages. In the second stage, a similar procedure may be followed as the first stage. However, in the second stage, instead of using zero memory for LPC synthesis, memory 629 from the past (e.g., a previous cycle or previous frame) may be used. For instance, for the first cycle (in a frame), memory that was updated at the end of the previous frame may be used; for the second cycle, memory that was updated at the end of the first cycle may be used and so on. Thus, scale factor determination block/module B 623*b* may produce a second scale factor (e.g., $S_k$) 635*b* and will take the first scaled excitation segment 615*b* from the first stage and scale it to obtain a second scaled excitation segment 615*c*.

LPC synthesis may then be performed using the second scaled excitation segment 615*c* by LPC filter C 617*c* to generate the synthesized speech segment 613. The synthesized speech segment 613 has the LPC spectral attributes as well as the appropriate scaling (that approximately matches the original speech signal).

The scale factor determination blocks/modules 623*a-b* may function according to a configuration. In one configuration (when the excitation signal is segmented according to pitch lag, for example), some excitation segments 615*a* may have more than one peak. In that configuration, a peak search within the frame may be performed. This may be done to ensure that in scale factor calculation, only one peak is used (e.g., not two peaks or multiple peaks). Thus, the determination of the scale factor (e.g., $S_k$ as illustrated in Equation 3 below) may use a summation based on a range (e.g., indices from j to n) that does not include multiple peaks. For instance, assume that an excitation segment is used that has two peaks. A peak search may be used that would indicate two peaks. Only a region or range including one peak may be used.

Other approaches in the art may not do an explicit peak search to ensure protection for multiple peaks and scaling. Largely, other approaches apply the scaling on not just pitch lag lengths but on larger segments (although a synthesis method itself may guarantee one peak in some configurations). In some configurations, the general synthesis approach does not guarantee that there is one peak in every cycle, because the pitch lag may be off or the pitch lag may change within the segment. In other words, the systems and methods disclosed herein may take the possibility of multiple peaks into account.

One feature of the systems and methods disclosed herein is that scaling and filtering may be done on a pitch cycle synchronous basis. For example, other approaches may simply scale the residual and filter, but that approach may not match up the energy to the original speech. However, the systems and methods disclosed herein may help to match up the energy of the original speech during every pitch cycle (when sent to the decoder, for example). Some traditional approaches may transmit a scale factor. However, the systems and methods herein may not transmit the scale factor. Rather, energy indicators (e.g., pitch cycle energy parameters) may be sent. That is, traditional approaches may transmit a gain or a scale factor directly applied to excitation signal, thus scaling the excitation in one step. However, the energy of the pitch cycle may not match up in that approach. Conversely, the systems and methods disclosed herein may help to ensure that the decoded speech signal matches the energy of the original speech for every pitch cycle.

For clarity, a more detailed explanation of the pitch synchronous gain scaling and LPC synthesis block/module 609 is given hereafter. LPC synthesis filter A 617*a* may obtain or receive an excitation segment 615*a*. The excitation segment 615*a* may be a segment of an excitation signal that is the length of a single pitch cycle, for example. Initially, LPC synthesis filter A 617*a* may use a zero memory input 619. LPC synthesis filter A 617*a* may produce a first synthesized segment 621. The first synthesized segment 621 may be denoted $x_1(i)$, for example. The first synthesized segment 621 from LPC synthesis filter A 617*a* may be provided to scale factor determination block/module A 623*a*. Scale factor determination block/module A 623*a* may use the first synthesized segment 621 (e.g., $x_1(i)$) and a pitch cycle energy input (e.g., $E_k$) 625 to produce a first scaling factor (e.g., $S_k$) 635*a*. The first scaling factor (e.g., $S_k$) 635*a* may be provided to a first multiplier 627*a*. The first multiplier 627*a* multiplies the excitation segment 615*a* by the first scaling factor (e.g., $S_k$) 635*a* to produce a first scaled excitation segment 615*b*. The first scaled excitation segment 615*b* (e.g., first multiplier 627*a* output) is provided to LPC synthesis filter B 617*b* and a second multiplier 627*b*.

LPC synthesis filter B 617*b* uses the first scaled excitation segment 615*b* as well as a memory input 629 (from previous operations) to produce a second synthesized segment (e.g., $x_2(i)$) 633 that is provided to scale factor determination block/module B 623*b*. The memory input 629 may come from the memory at the end of a previous frame and/or from a previous pitch cycle, for example. Scale factor determination block/module B 623*b* uses the second synthesized segment (e.g., $x_2(i)$) 633 in addition to the pitch cycle energy input (e.g., $E_k$) 625 in order to produce a second scaling factor (e.g., $S_k$) 635*b*, which is provided to the second multiplier 627*b*. The second multiplier 627*b* multiplies the first scaled excitation segment 615*b* by the second scaling factor (e.g., $S_k$) 635*b* to produce a second scaled excitation segment 615*c*. The second scaled excitation segment 615*c* is provided to LPC synthesis filter C 617*c*. LPC synthesis filter C 617*c* uses the second scaled excitation segment 615*c* in addition to the memory input 629 to produce a synthesized speech signal 613 and memory 631 for further operations.

Figure 7:
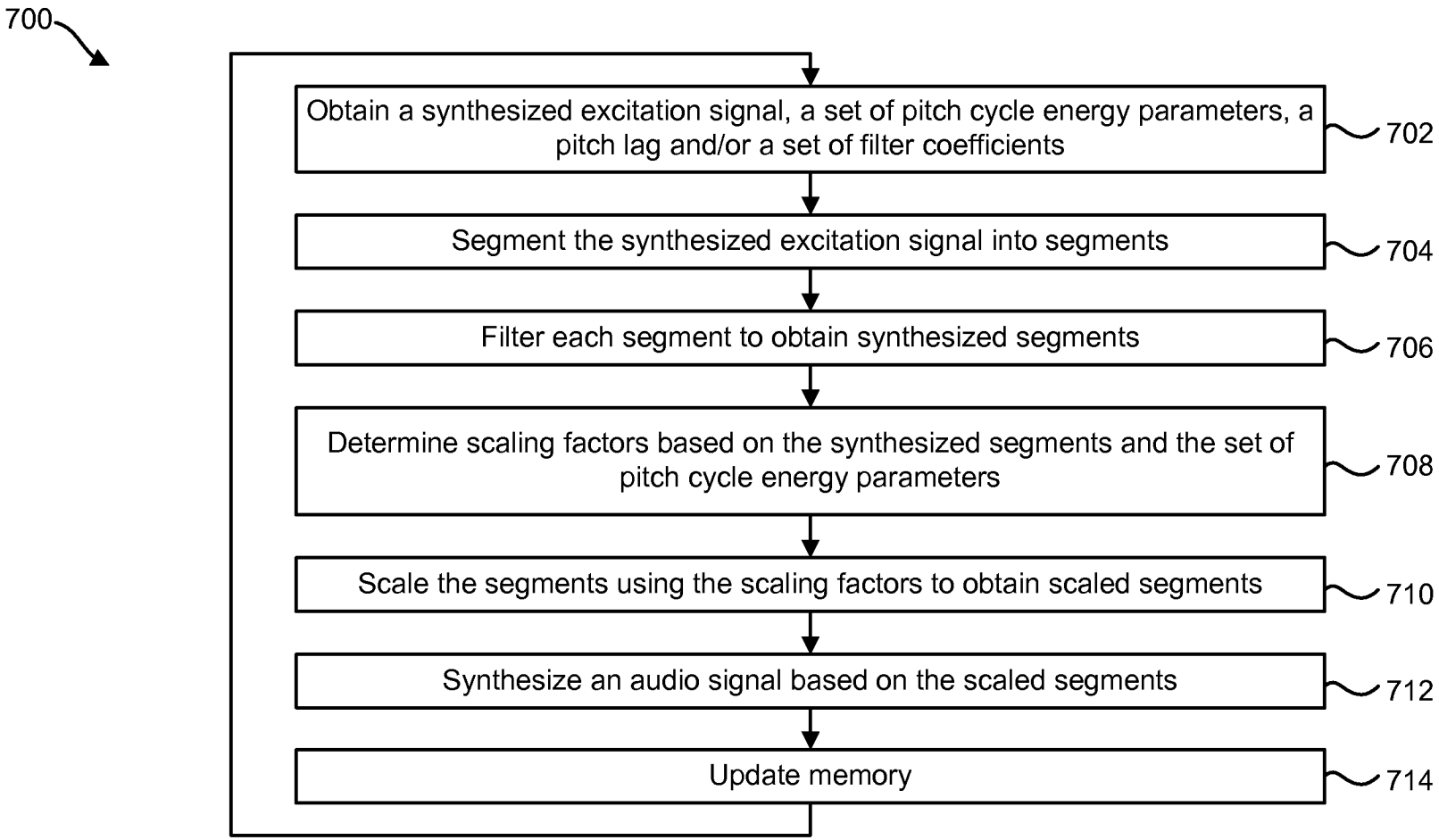
FIG. 7 is a flow diagram illustrating one configuration of a method for scaling an excitation signal.

FIG. 7 is a flow diagram illustrating one configuration of a method 700 for scaling an excitation signal. The method 700 illustrated may use a synthesized (LPC) excitation signal, a set of pitch cycle energy parameters, a pitch lag and/or a set of (LPC) filter coefficients. An electronic device may obtain 702 a synthesized excitation signal 501, a set of pitch cycle energy parameters 507, a pitch lag 596 and/or a set of filter coefficients 511. For example, the electronic device may generate the synthesized excitation signal 501 based on a pitch lag 596 and/or a previous frame residual signal 594. The electronic device may generate the pitch lag 596 or may receive it from another device.

In one configuration, the electronic device may generate or determine the set of pitch cycle energy parameters 507 as described above in connection with FIG. 2 or FIG. 4. For instance, the set of pitch cycle energy parameters 507 may be the second set of pitch cycle energy parameters determined as described above. In another configuration, the electronic device may receive the set of pitch cycle energy parameters 507 sent from another device. In one configuration, the electronic device may generate the filter coefficients 511. In another configuration, the electronic device may receive the filter coefficients 511 from another device.

The electronic device may segment 704 the synthesized excitation signal 501 into segments. In one configuration, the electronic device may segment 704 the excitation 501 based on the pitch lag 596. For example, the electronic device may segment 704 the excitation 501 into segments that are the same length as the pitch lag 596. In another configuration, the electronic device may segment 704 the excitation 501 such that each segment contains one peak.

The electronic device may filter 706 each segment to obtain synthesized segments. For example, the electronic device may filter 706 each segment (e.g., unscaled and/or scaled segments) using an LPC synthesis filter and a memory input. For instance, the LPC synthesis filter may use a zero memory input and/or a memory input from previous operations (e.g., from a previous pitch cycle or previous frame synthesis).

The electronic device may determine 708 scaling factors based on the synthesized segments (e.g., LPC filter outputs) and the set of pitch cycle energy parameters. In one configuration, where each segment only contains one peak, the scaling factors (e.g., $S_k$) may be determined as illustrated by Equation (1).

$$S_{k,m} = \frac{E_k}{\sum_{i=0}^{L_k} x_m(i)} \tag{1}$$

In Equation (1), $S_{k,m}$ is a scaling factor for a $k^{th}$ segment and an $m^{th}$ filter output or stage, $E_k$ is a pitch cycle energy parameter, $L_k$ is the length of a $k^{th}$ segment and $x_m$ is a synthesized segment (e.g., an LPC filter output), where m is represents a filter output. For example, $x_1$ is a first filter output and $x_2$ is a second filter output in a series of LPC synthesis filters. It should be noted that Equation (1) only illustrates one example of how the scaling factors may be determined 708. Other approaches may be used to determine 708 scaling factors, for instance, when a segment includes more than one peak.

The electronic device may scale 710 the segments (of the synthesized excitation) using the scaling factors to obtain scaled segments. For example, the electronic device may multiply an excitation segment (e.g., unscaled and/or scaled excitation segments) by one or more scaling factors. For instance, the electronic device may first multiply an unscaled excitation segment by a first scaling factor to obtain a first scaled segment. The electronic device may then multiply the first scaled segment by a second scaling factor to obtain a second scaled segment.

It should be noted that filtering 706 each segment, determining 708 scaling factors and scaling 710 the segments may be repeated and/or performed in a different order than illustrated in FIG. 7. For example, the electronic device may filter 706 a segment 615*a* to obtain a first synthesized segment 621, determine 708 a first scaling factor 635*a* based on the first synthesized segment 621 and scale 710 the segment 615*a* using the scaling factor 635*a* to obtain a first scaled segment 615*b*. The steps 706, 708, 710 may then be repeated. For instance, the electronic device may then filter 706 the first scaled segment 615*b* to obtain a second synthesized segment 633, determine 708 a second scaling factor 635*b* based on the second synthesized segment 633 and scale 710 the first scaled segment 615*b* to obtain a second scaled segment 615*c*. Thus, for instance, the electronic device may filter 706 a segment 615*a* to obtain a first synthesized segment 621 and may filter 706 the first scaled segment 615*b* (which was obtained based on segment 615*a* and the synthesized segment 621) to obtain the second synthesized segment 633. Furthermore, the electronic device may determine 708 the first scaling factor 635*a* and the second scaling factor 635*b* based respectively on the first synthesized segment 621 and the second synthesized segment 633 (in addition to the pitch cycle energy parameter 625). Additionally, the electronic device may scale 710 the segment 615*a* (to obtain the first scaled segment 615*b*) and the first scaled segment 615*b* (to obtain the second scaled segment 615*c*).

The electronic device may synthesize 712 an audio (e.g., speech) signal based on the scaled segments. For example, the electronic device may LPC filter a scaled excitation segment in order to generate a synthesized speech signal 513. In one configuration, the LPC filter may use the scaled segment and a memory input from previous operations (e.g., memory from a previous frame and/or from a previous pitch cycle) to generate the synthesized speech signal 513.

The electronic device may update 714 memory. For example, the electronic device may store information corresponding to the synthesized speech signal in order to update 714 synthesis filter memory.

Figure 8:
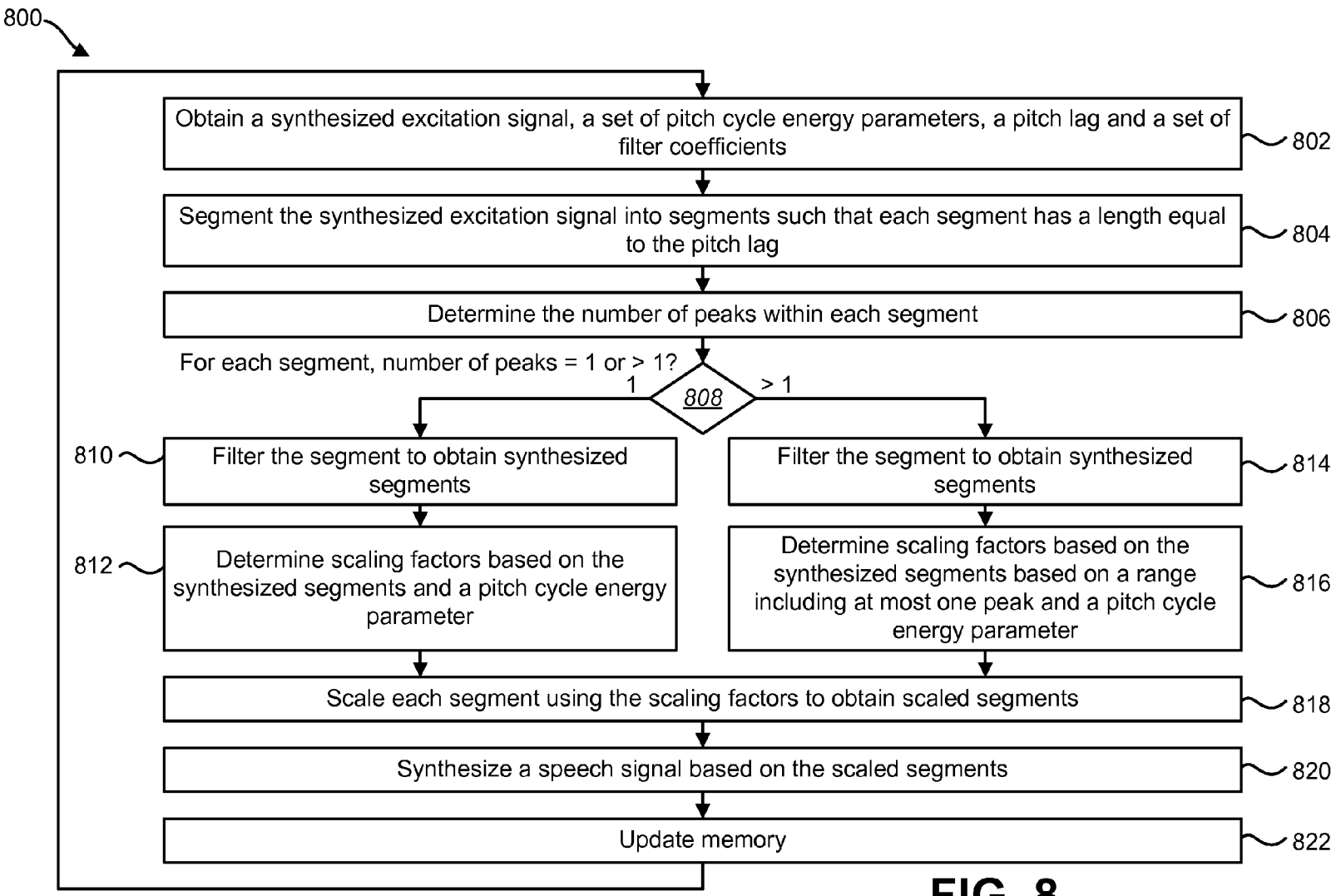
FIG. 8 is a flow diagram illustrating a more specific configuration of a method for scaling an excitation signal.

FIG. 8 is a flow diagram illustrating a more specific configuration of a method 800 for scaling an excitation signal. The method 800 illustrated may use a synthesized (LPC) excitation signal, a set of pitch cycle energy parameters, a pitch lag and/or a set of (LPC) filter coefficients. An electronic device may obtain 802 a synthesized excitation signal 501, a set of pitch cycle energy parameters 507, a pitch lag 596 and/or a set of filter coefficients 511. For example, the electronic device may generate the synthesized excitation signal 501 based on a pitch lag 596 and/or a previous frame residual signal 594. The electronic device may generate the pitch lag 596 or may receive it from another device.

In one configuration, the electronic device may generate or determine the set of pitch cycle energy parameters 507 as described above in connection with FIG. 2 or FIG. 4. For instance, the set of pitch cycle energy parameters 507 may be the second set of pitch cycle energy parameters determined as described above. In another configuration, the electronic device may receive the set of pitch cycle energy parameters 507 sent from another device. In one configuration, the electronic device may generate the filter coefficients 511. In another configuration, the electronic device may receive the filter coefficients 511 from another device.

The electronic device may segment 804 the synthesized excitation signal 501 into segments such that each segment is of a length equal to the pitch lag 596. For example, the electronic device may obtain the pitch lag 596 in a number of samples or a period of time. The electronic device may then segment, divide and/or designate portions of a frame of the synthesized excitation signal into one or more segments of length equal to the pitch lag 596.

The electronic device may determine 806 a number of peaks within each of the segments. For example, the electronic device may search each segment to determine 806 how many peaks (e.g., one or more) are included within each of the segments. In one configuration, the electronic device may obtain a residual signal based on the segment and find regions of high energy within the residual. For example, one or more points in the residual that satisfy one or more thresholds may be peaks.

The electronic device may determine 808 whether the number of peaks for each segment is equal to one or is greater than one (e.g., greater than or equal to two). If the number of peaks for a segment is equal to one, the electronic device may filter 810 the segment to obtain synthesized segments. The electronic device may also determine 812 scaling factors based on the synthesized segments and a pitch cycle energy parameter. In one configuration, the scaling factors may be determined as illustrated by Equation (2).

$$S_{k,m} = \frac{E_k}{\sum_{i=0}^{L_k} x_m(i)} \tag{2}$$

In Equation (2), $S_{k,m}$ is a scaling factor for a $k^{th}$ segment, $E_k$ is a pitch cycle energy parameter for a $k^{th}$ segment, $L_k$ is the length of a $k^{th}$ segment and $x_m$ is a synthesized segment (e.g., an LPC filter output), where m is represents a filter output (number or index, for example). For example, $x_1$ is a first filter output and $x_2$ is a second filter output in a number (e.g., series) of LPC synthesis filters. As can be observed, the summation in the denominator of Equation (2) may be performed over the entire length of the segment in this case (e.g., the case when there is only one peak in the segment).

If the number of peaks for a segment is greater than one, the electronic device may filter 814 the segment to obtain synthesized segments. The electronic device may also determine 816 scaling factors based on the synthesized segments based on a range including at most one peak and a pitch cycle energy parameter. In one configuration, the scaling factors may be determined as illustrated by Equation (3).

$$S_{k,m} = \frac{E_k}{\sum_{i=j}^{n} x_m(i)} \tag{3}$$

In Equation (3), $S_{k,m}$ is a scaling factor, $E_k$ is a pitch cycle energy parameter, k is a segment number or index, $x_m$ is a synthesized segment, where m is represents a filter output. For example, $x_1$ is a first synthesized segment (e.g., filter output) and $x_2$ is a second synthesized segment (e.g., filter output) in a number (e.g., series) of LPC synthesis filters. Furthermore, j and n are indices selected to include at most one peak within the excitation as illustrated in Equation (4).

$$|n-j| \leq L_k \tag{4}$$

The electronic device may scale 818 each segment (of the synthesized excitation) using the scaling factors to obtain scaled segments. For example, the electronic device may multiply an excitation segment (e.g., unscaled and/or scaled excitation segments) by one or more scaling factors. For instance, the electronic device may first multiply an unscaled excitation segment 615*a* by a first scaling factor 635*a* to obtain a first scaled segment 615*b*. The electronic device may then multiply the first scaled segment 615*b* by a second scaling factor 635*b* to obtain a second scaled segment 615*c*.

The electronic device may synthesize 820 a speech signal based on the scaled segments. For example, the electronic device may LPC filter a scaled excitation segment in order to generate a synthesized speech signal 513. In one configuration, the LPC filter may use the scaled segment and a memory input from previous operations (e.g., memory from a previous frame and/or from a previous pitch cycle) to generate the synthesized speech signal 513.

The electronic device may update 822 memory. For example, the electronic device may store information corresponding to the synthesized speech signal in order to update 714 synthesis filter memory.

Figure 9:
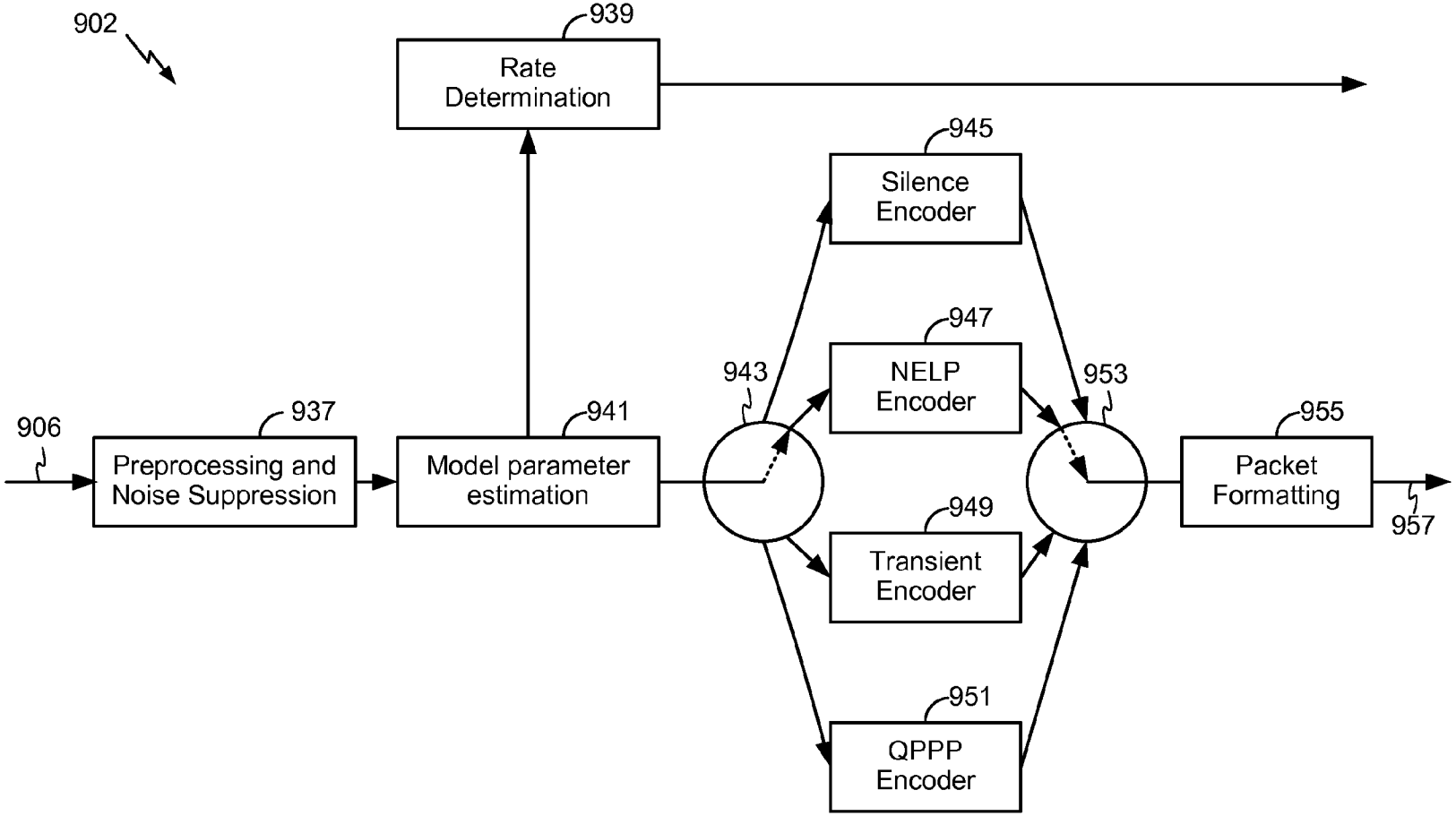
FIG. 9 is a block diagram illustrating one example of an electronic device in which systems and methods for determining pitch cycle energy may be implemented.

FIG. 9 is a block diagram illustrating one example of an electronic device 902 in which systems and methods for determining pitch cycle energy may be implemented. In this example, the electronic device 902 includes a preprocessing and noise suppression block/module 937, a model parameter estimation block/module 941, a rate determination block/module 939, a first switching block/module 943, a silence encoder 945, a noise excited linear prediction (NELP) encoder 947, a transient encoder 949, a quarter-rate prototype pitch period (QPPP) encoder 951, a second switching block/module 953 and a packet formatting block/module 955.

The preprocessing and noise suppression block/module 937 may obtain or receive a speech signal 906. In one configuration, the preprocessing and noise suppression block/module 937 may suppress noise in the speech signal 906 and/or perform other processing on the speech signal 906, such as filtering. The resulting output signal is provided to a model parameter estimation block/module 941.

The model parameter estimation block/module 941 may estimate LPC coefficients through linear prediction analysis, estimate a first approximation pitch lag and estimate the autocorrelation at the first approximation pitch lag. The rate determination block/module 939 may determine a coding rate for encoding the speech signal 906. The coding rate may be provided to a decoder for use in decoding the (encoded) speech signal 906.

The electronic device 902 may determine which encoder to use for encoding the speech signal 906. It should be noted that, at times, the speech signal 906 may not always contain actual speech, but may contain silence and/or noise, for example. In one configuration, the electronic device 902 may determine which encoder to use based on the model parameter estimation 941. For example, if the electronic device 902 detects silence in the speech signal 906, it 902 may use the first switching block/module 943 to channel the (silent) speech signal through the silence encoder 945. The first switching block/module 943 may be similarly used to switch the speech signal 906 for encoding by the NELP encoder 947, the transient encoder 949 or the QPPP encoder 951, based on the model parameter estimation 941.

The silence encoder 945 may encode or represent the silence with one or more pieces of information. For instance, the silence encoder 945 could produce a parameter that represents the length of silence in the speech signal 906.

The noise-excited linear predictive (NELP) encoder 947 may be used to code frames classified as unvoiced speech. NELP coding operates effectively, in terms of signal reproduction, where the speech signal 906 has little or no pitch structure. More specifically, NELP may be used to encode speech that is noise-like in character, such as unvoiced speech or background noise. NELP uses a filtered pseudo-random noise signal to model unvoiced speech. The noise-like character of such speech segments can be reconstructed by generating random signals at the decoder and applying appropriate gains to them. NELP may use a simple model for the coded speech, thereby achieving a lower bit rate.

The transient encoder 949 may be used to encode transient frames in the speech signal 906. More specifically, the electronic device 902 may use the transient encoder 949 to encode the speech signal 906 when a transient frame is detected. In one configuration, the encoders 104, 304 described in connection with FIGS. 1 and 3 above may be examples of a transient encoder 949. For instance, a transient encoder 949 may determine pitch cycle energy parameters such that a decoder may be able to match the energy contour from the original speech signal 906 in transient frames. Although the transient encoder 949 is given as one possible application of the systems and methods disclosed herein, it should be noted that the systems and methods disclosed herein may be applied to other types of encoders (e.g., silence encoders 945, NELP encoders 947 and/or prototype pitch period (PPP) encoders such as the QPPP encoder 951, etc.).

The quarter-rate prototype pitch period (QPPP) encoder 951 may be used to code frames classified as voiced speech. Voiced speech contains slowly time varying periodic components that are exploited by the QPPP encoder 951. The QPPP encoder 951 codes a subset of the pitch periods within each frame. The remaining periods of the speech signal 906 are reconstructed by interpolating between these prototype periods. By exploiting the periodicity of voiced speech, the QPPP encoder 951 is able to reproduce the speech signal 906 in a perceptually accurate manner.

The QPPP encoder 951 may use prototype pitch period waveform interpolation (PPPWI), which may be used to encode speech data that is periodic in nature. Such speech is characterized by different pitch periods being similar to a "prototype" pitch period (PPP). This PPP may be voice information that the QPPP encoder 951 uses to encode. A decoder can use this PPP to reconstruct other pitch periods in the speech segment.

The second switching block/module 953 may be used to channel the (encoded) speech signal from the encoder 945, 947, 949, 951 that was used to code the current frame to the packet formatting block/module 955. The packet formatting block/module 955 may format the (encoded) speech signal 906 into one or more packets 957 (for transmission, for example). For instance, the packet formatting block/module 955 may format a packet 957 for a transient frame. In one configuration, the one or more packets 957 produced by the packet formatting block/module 955 may be transmitted to another device.

Figure 10:
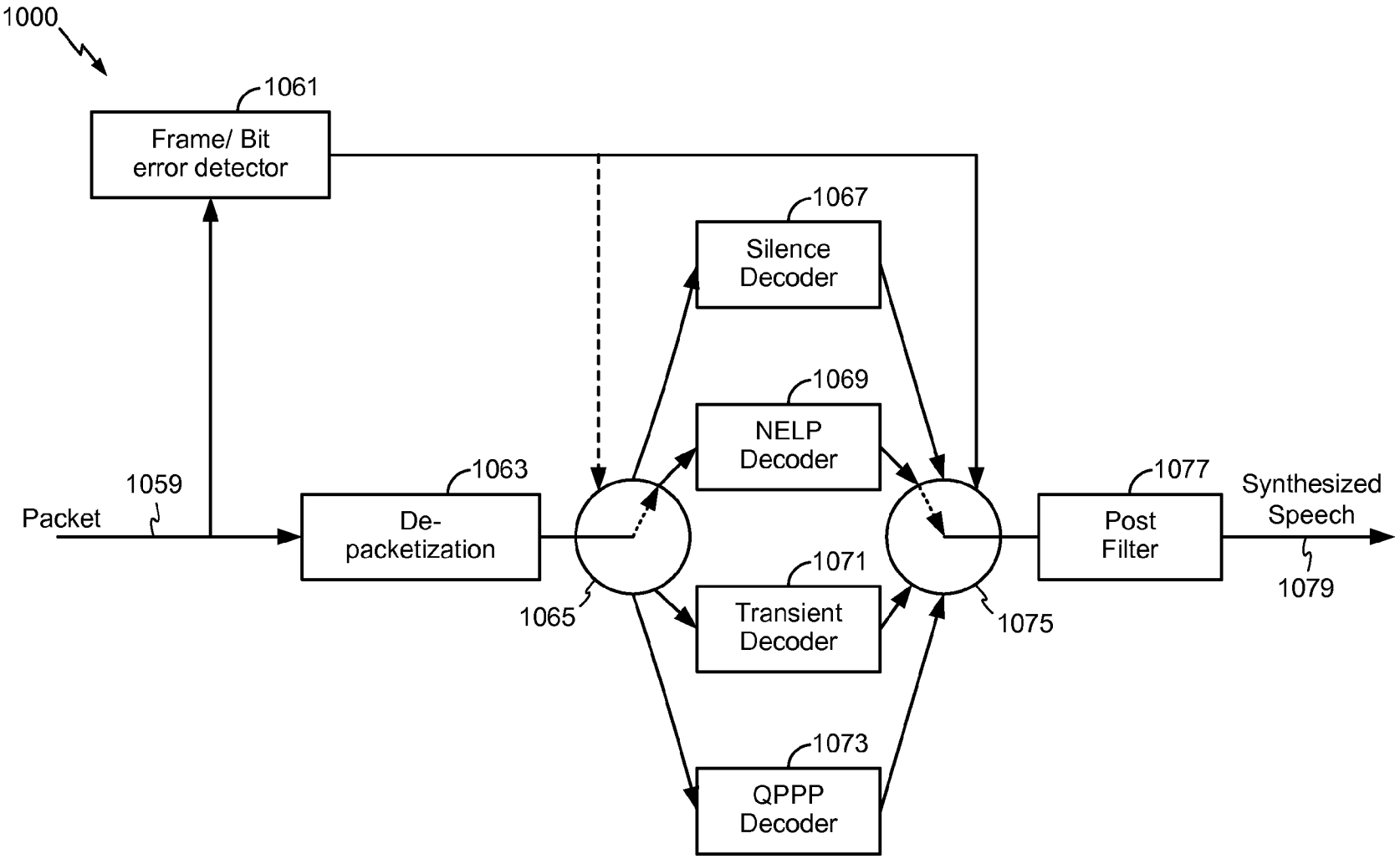
FIG. 10 is a block diagram illustrating one example of an electronic device in which systems and methods for scaling an excitation signal may be implemented.

FIG. 10 is a block diagram illustrating one example of an electronic device 1000 in which systems and methods for scaling an excitation signal may be implemented. In this example, the electronic device 1000 includes a frame/bit error detector 1061, a de-packetization block/module 1063, a first switching block/module 1065, a silence decoder 1067, a noise excited linear predictive (NELP) decoder 1069, a transient decoder 1071, a quarter-rate prototype pitch period (QPPP) decoder 1073, a second switching block/module 1075 and a post filter 1077.

The electronic device 1000 may receive a packet 1059. The packet 1059 may be provided to the frame/bit error detector 1061 and the de-packetization block/module 1063. The de-packetization block/module 1063 may "unpack" information from the packet 1059. For example, a packet 1059 may include header information, error correction information, routing information and/or other information in addition to payload data. The de-packetization block/module 1063 may extract the payload data from the packet 1059. The payload data may be provided to the first switching block/module 1065.

The frame/bit error detector 1061 may detect whether part or all of the packet 1059 was received incorrectly. For example, the frame/bit error detector 1061 may use an error detection code (sent with the packet 1059) to determine whether any of the packet 1059 was received incorrectly. In some configurations, the electronic device 1000 may control the first switching block/module 1065 and/or the second switching block/module 1075 based on whether some or all of the packet 1059 was received incorrectly, which may be indicated by the frame/bit error detector 1061 output.

Additionally or alternatively, the packet 1059 may include information that indicates which type of decoder should be used to decode the payload data. For example, an encoding electronic device 902 may send two bits that indicate the encoding mode. The (decoding) electronic device 1000 may use this indication to control the first switching block/module 1065 and the second switching block/module 1075.

The electronic device 1000 may thus use the silence decoder 1067, the NELP decoder 1069, the transient decoder 1071 and/or the QPPP decoder 1073 to decode the payload data from the packet 1059. The decoded data may then be provided to the second switching block/module 1075, which may route the decoded data to the post filter 1077. The post filter 1077 may perform some filtering on the decoded data and output a synthesized speech signal 1079.

In one example, the packet 1059 may indicate (with the coding mode indicator) that a silence encoder 945 was used to encode the payload data. The electronic device 1000 may control the first switching block/module 1065 to route the payload data to the silence decoder 1067. The decoded (silent) payload data may then be provided to the second switching block/module 1075, which may route the decoded payload data to the post filter 1077. In another example, the NELP decoder 1069 may be used to decode a speech signal (e.g., unvoiced speech signal) that was encoded by a NELP encoder 947.

In another example, the packet 1059 may indicate that the payload data was encoded using a transient encoder 949 (using a coding mode indicator, for example). Thus, the electronic device 1000 may use the first switching block/module 1065 to route the payload data to the transient decoder 1071. The transient decoder 1071 may be one example of the decoder 592 described above in connection with FIG. 5. Thus, the transient decoder 1071 may decode the payload data as described above. It should be noted, however, that the systems and methods disclosed herein may be applied to other decoders, such as the silence decoder 1067, NELP decoder 1069 and/or prototype pitch period (PPP) decoders (e.g., the QPPP decoder 1073). The QPPP decoder 1073 may be used to decode a speech signal (e.g., voiced speech signal) that was encoded by a QPPP encoder 951.

The decoded data may be provided to the second switching block/module 1075, which may route it to the post filter 1077. The post filter 1077 may perform some filtering on the signal, which may be output as a synthesized speech signal 1079. The synthesized speech signal 1079 may then be stored, output (using a speaker, for example) and/or transmitted to another device (e.g., a Bluetooth headset).

Figure 11:
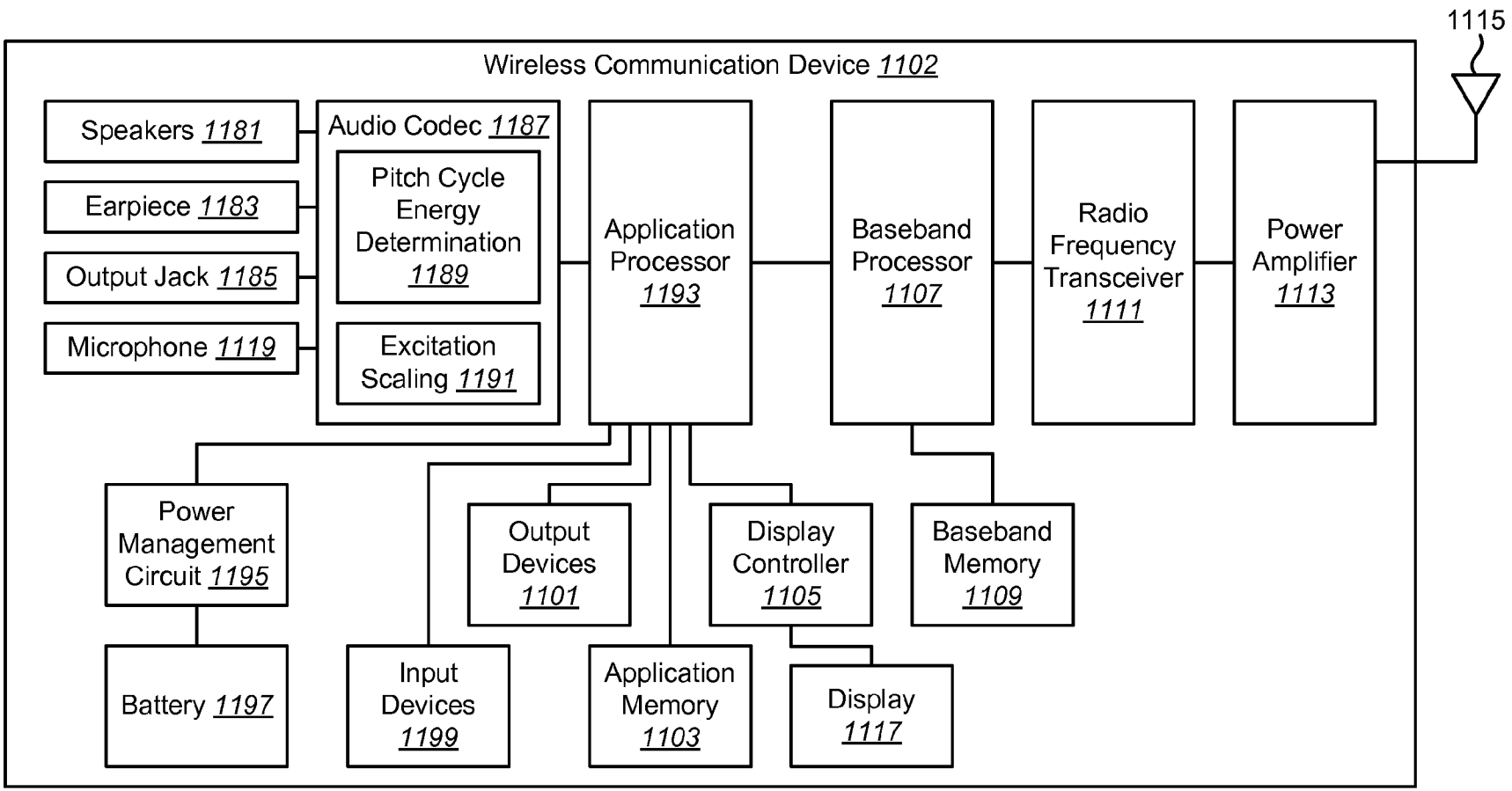
FIG. 11 is a block diagram illustrating one configuration of a wireless communication device in which systems and methods for determining pitch cycle energy and/or scaling an excitation signal may be implemented.

FIG. 11 is a block diagram illustrating one configuration of a wireless communication device 1102 in which systems and methods for determining pitch cycle energy and/or scaling an excitation signal may be implemented. The wireless communication device 1102 may include an application processor 1193. The application processor 1193 generally processes instructions (e.g., runs programs) to perform functions on the wireless communication device. The application processor 1193 may be coupled to an audio coder/decoder (codec) 1187.

The audio codec 1187 may be an electronic device (e.g., integrated circuit) used for coding and/or decoding audio signals. The audio codec 1187 may be coupled to one or more speakers 1181, an earpiece 1183, an output jack 1185 and/or one or more microphones 1119. The speakers 1181 may include one or more electro-acoustic transducers that convert electrical or electronic signals into acoustic signals. For example, the speakers 1181 may be used to play music or output a speakerphone conversation, etc. The earpiece 1183 may be another speaker or electro-acoustic transducer that can be used to output acoustic signals (e.g., speech signals) to a user. For example, the earpiece 1183 may be used such that only a user may reliably hear the acoustic signal. The output jack 1185 may be used for coupling other devices to the wireless communication device 1102 for outputting audio, such as headphones. The speakers 1181, earpiece 1183 and/or output jack 1185 may generally be used for outputting an audio signal from the audio codec 1187. The one or more microphones 1119 may be acousto-electric transducer that converts an acoustic signal (such as a user's voice) into electrical or electronic signals that are provided to the audio codec 1187.

The audio codec 1187 may include a pitch cycle energy determination block/module 1189. In one configuration, the pitch cycle energy determination block/module 1189 is included in an encoder, such as the encoders 104, 304 described in connection with FIGS. 1 and 3 above. The pitch cycle energy determination block/module 1189 may be used to perform one or more of the methods 200, 400 described above in connection with FIGS. 2 and 4 for determining a set of pitch cycle energy parameters according to the systems and methods disclosed herein.

The audio codec 1187 may additionally or alternatively include an excitation scaling block/module 1191. In one configuration, the excitation scaling block/module 1191 is included in a decoder, such as the decoder 592 described above in connection with FIG. 5. The excitation scaling block/module 1191 may perform one or more of the methods 700, 800 described in connection with FIGS. 7 and 8 above.

The application processor 1193 may also be coupled to a power management circuit 1195. One example of a power management circuit is a power management integrated circuit (PMIC), which may be used to manage the electrical power consumption of the wireless communication device 1102. The power management circuit 1195 may be coupled to a battery 1197. The battery 1197 may generally provide electrical power to the wireless communication device 1102.

The application processor 1193 may be coupled to one or more input devices 1199 for receiving input. Examples of input devices 1199 include infrared sensors, image sensors, accelerometers, touch sensors, keypads, etc. The input devices 1199 may allow user interaction with the wireless communication device 1102. The application processor 1193 may also be coupled to one or more output devices 1101. Examples of output devices 1101 include printers, projectors, screens, haptic devices, etc. The output devices 1101 may allow the wireless communication device 1102 to produce output that may be experienced by a user.

The application processor 1193 may be coupled to application memory 1103. The application memory 1103 may be any electronic device that is capable of storing electronic information. Examples of application memory 1103 include double data rate synchronous dynamic random access memory (DDRAM), synchronous dynamic random access memory (SDRAM), flash memory, etc. The application memory 1103 may provide storage for the application processor 1193. For instance, the application memory 1103 may store data and/or instructions for the functioning of programs that are run on the application processor 1193.

The application processor 1193 may be coupled to a display controller 1105, which in turn may be coupled to a display 1117. The display controller 1105 may be a hardware block that is used to generate images on the display 1117. For example, the display controller 1105 may translate instructions and/or data from the application processor 1193 into images that can be presented on the display 1117. Examples of the display 1117 include liquid crystal display (LCD) panels, light emitting diode (LED) panels, cathode ray tube (CRT) displays, plasma displays, etc.

The application processor 1193 may be coupled to a baseband processor 1107. The baseband processor 1107 generally processes communication signals. For example, the baseband processor 1107 may demodulate and/or decode received signals. Additionally or alternatively, the baseband processor 1107 may encode and/or modulate signals in preparation for transmission.

The baseband processor 1107 may be coupled to baseband memory 1109. The baseband memory 1109 may be any electronic device capable of storing electronic information, such as SDRAM, DDRAM, flash memory, etc. The baseband processor 1107 may read information (e.g., instructions and/or data) from and/or write information to the baseband memory 1109. Additionally or alternatively, the baseband processor 1107 may use instructions and/or data stored in the baseband memory 1109 to perform communication operations.

The baseband processor 1107 may be coupled to a radio frequency (RF) transceiver 1111. The RF transceiver 1111 may be coupled to a power amplifier 1113 and one or more antennas 1115. The RF transceiver 1111 may transmit and/or receive radio frequency signals. For example, the RF transceiver 1111 may transmit an RF signal using a power amplifier 1113 and one or more antennas 1115. The RF transceiver 1111 may also receive RF signals using the one or more antennas 1115. The wireless communication device 1102 may be one example of an electronic device 102, 168, 902, 1000, 1202 or wireless communication device 1300 as described herein.

Figure 12:
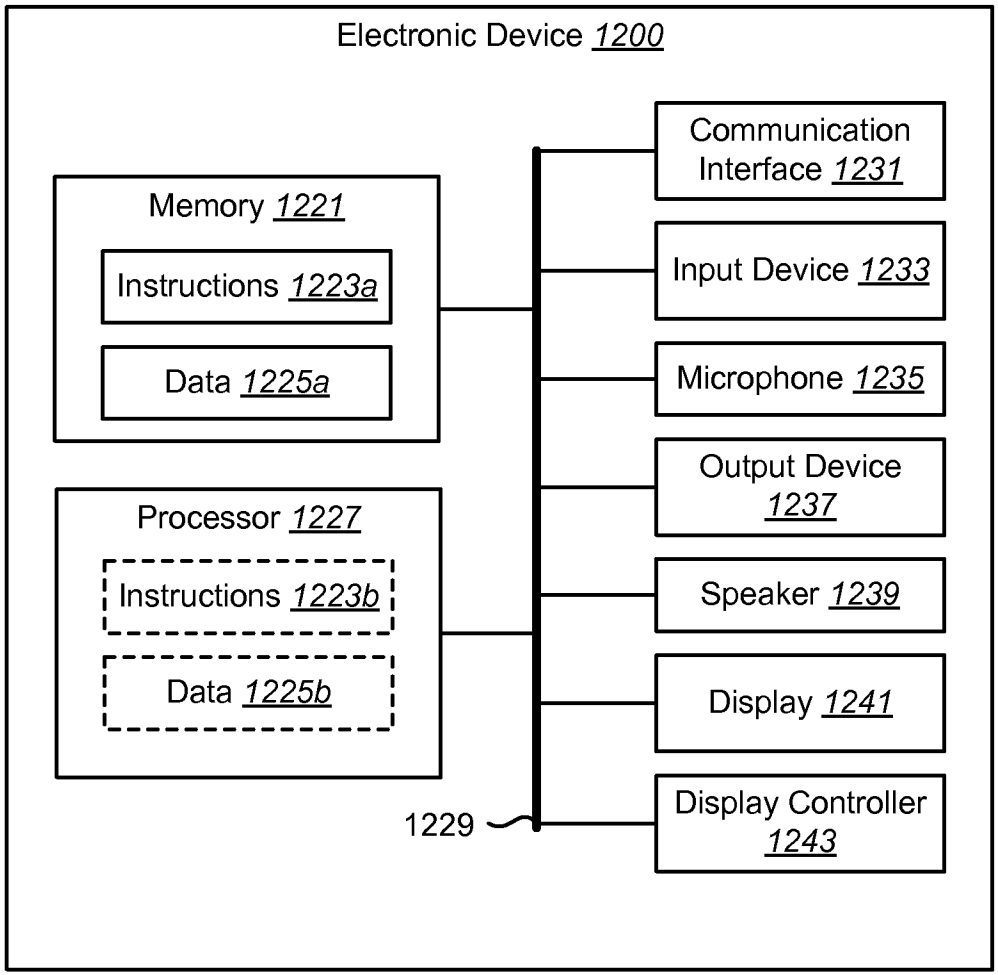
FIG. 12 illustrates various components that may be utilized in an electronic device.

FIG. 12 illustrates various components that may be utilized in an electronic device 1200. The illustrated components may be located within the same physical structure or in separate housings or structures. One or more of the electronic devices 102, 168, 902, 1000 described previously may be configured similarly to the electronic device 1200. The electronic device 1200 includes a processor 1227. The processor 1227 may be a general purpose single- or multi-chip microprocessor (e.g., an ARM), a special purpose microprocessor (e.g., a digital signal processor (DSP)), a microcontroller, a programmable gate array, etc. The processor 1227 may be referred to as a central processing unit (CPU). Although just a single processor 1227 is shown in the electronic device 1200 of FIG. 12, in an alternative configuration, a combination of processors (e.g., an ARM and DSP) could be used.

The electronic device 1200 also includes memory 1221 in electronic communication with the processor 1227. That is, the processor 1227 can read information from and/or write information to the memory 1221. The memory 1221 may be any electronic component capable of storing electronic information. The memory 1221 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1225*a* and instructions 1223*a* may be stored in the memory 1221. The instructions 1223*a* may include one or more programs, routines, sub-routines, functions, procedures, etc. The instructions 1223*a* may include a single computer-readable statement or many computer-readable statements. The instructions 1223*a* may be executable by the processor 1227 to implement one or more of the methods 200, 400, 700, 800 described above. Executing the instructions 1223*a* may involve the use of the data 1225*a* that is stored in the memory 1221. FIG. 12 shows some instructions 1223*b* and data 1225*b* being loaded into the processor 1227 (which may come from instructions 1223*a* and data 1225*a*).

The electronic device 1200 may also include one or more communication interfaces 1231 for communicating with other electronic devices. The communication interfaces 1231 may be based on wired communication technology, wireless communication technology, or both. Examples of different types of communication interfaces 1231 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The electronic device 1200 may also include one or more input devices 1233 and one or more output devices 1237. Examples of different kinds of input devices 1233 include a keyboard, mouse, microphone, remote control device, button, joystick, trackball, touchpad, lightpen, etc. For instance, the electronic device 1200 may include one or more microphones 1235 for capturing acoustic signals. In one configuration, a microphone 1235 may be a transducer that converts acoustic signals (e.g., voice, speech) into electrical or electronic signals. Examples of different kinds of output devices 1237 include a speaker, printer, etc. For instance, the electronic device 1200 may include one or more speakers 1239. In one configuration, a speaker 1239 may be a transducer that converts electrical or electronic signals into acoustic signals. One specific type of output device which may be typically included in an electronic device 1200 is a display device 1241. Display devices 1241 used with configurations disclosed herein may utilize any suitable image projection technology, such as a cathode ray tube (CRT), liquid crystal display (LCD), light-emitting diode (LED), gas plasma, electroluminescence, or the like. A display controller 1243 may also be provided, for converting data stored in the memory 1221 into text, graphics, and/or moving images (as appropriate) shown on the display device 1241.

The various components of the electronic device 1200 may be coupled together by one or more buses, which may include a power bus, a control signal bus, a status signal bus, a data bus, etc. For simplicity, the various buses are illustrated in FIG. 12 as a bus system 1229. It should be noted that FIG. 12 illustrates only one possible configuration of an electronic device 1200. Various other architectures and components may be utilized.

Figure 13:
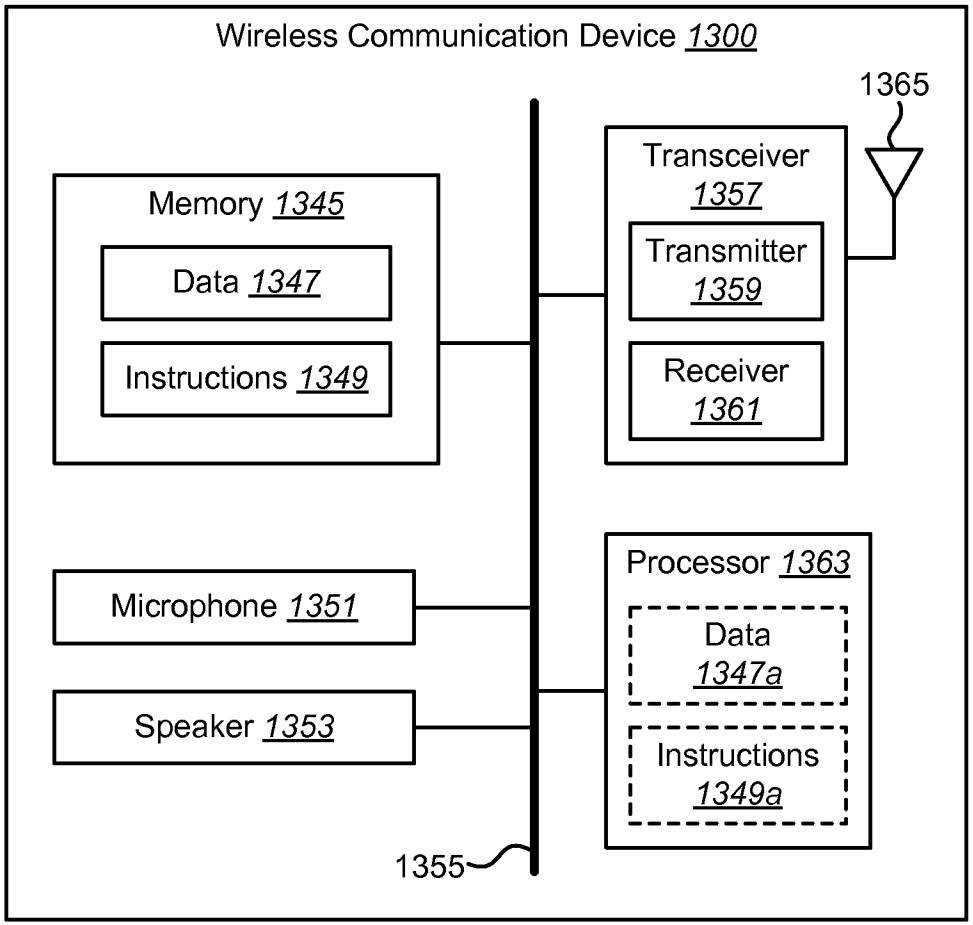
FIG. 13 illustrates certain components that may be included within a wireless communication device.

FIG. 13 illustrates certain components that may be included within a wireless communication device 1300. One or more of the electronic devices 102, 168, 902, 1000, 1200 and/or the wireless communication device 1102 described above may be configured similarly to the wireless communication device 1300 that is shown in FIG. 13.

The wireless communication device 1300 includes a processor 1363. The processor 1363 may be a general purpose single- or multi-chip microprocessor (e.g., an ARM), a special purpose microprocessor (e.g., a digital signal processor (DSP)), a microcontroller, a programmable gate array, etc. The processor 1363 may be referred to as a central processing unit (CPU). Although just a single processor 1363 is shown in the wireless communication device 1300 of FIG. 13, in an alternative configuration, a combination of processors (e.g., an ARM and DSP) could be used.

The wireless communication device 1300 also includes memory 1345 in electronic communication with the processor 1363 (i.e., the processor 1363 can read information from and/or write information to the memory 1345). The memory 1345 may be any electronic component capable of storing electronic information. The memory 1345 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1347 and instructions 1349 may be stored in the memory 1345. The instructions 1349 may include one or more programs, routines, sub-routines, functions, procedures, code, etc. The instructions 1349 may include a single computer-readable statement or many computer-readable statements. The instructions 1349 may be executable by the processor 1363 to implement one or more of the methods 200, 400, 700, 800 described above. Executing the instructions 1349 may involve the use of the data 1347 that is stored in the memory 1345. FIG. 13 shows some instructions 1349*a* and data 1347*a* being loaded into the processor 1363 (which may come from instructions 1349 and data 1347).

The wireless communication device 1300 may also include a transmitter 1359 and a receiver 1361 to allow transmission and reception of signals between the wireless communication device 1300 and a remote location (e.g., another electronic device, wireless communication device, etc.). The transmitter 1359 and receiver 1361 may be collectively referred to as a transceiver 1357. An antenna 1365 may be electrically coupled to the transceiver 1357. The wireless communication device 1300 may also include (not shown) multiple transmitters, multiple receivers, multiple transceivers and/or multiple antenna.

In some configurations, the wireless communication device 1300 may include one or more microphones 1351 for capturing acoustic signals. In one configuration, a microphone 1351 may be a transducer that converts acoustic signals (e.g., voice, speech) into electrical or electronic signals. Additionally or alternatively, the wireless communication device 1300 may include one or more speakers 1353. In one configuration, a speaker 1353 may be a transducer that converts electrical or electronic signals into acoustic signals.

The various components of the wireless communication device 1300 may be coupled together by one or more buses, which may include a power bus, a control signal bus, a status signal bus, a data bus, etc. For simplicity, the various buses are illustrated in FIG. 13 as a bus system 1355.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The functions described herein may be stored as one or more instructions on a processor-readable or computer-readable medium. The term "computer-readable medium" refers to any available medium that can be accessed by a computer or processor. By way of example, and not limitation, such a medium may comprise RAM, ROM, EEPROM, flash memory, CD-ROM or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

The invention claimed is:

1. An electronic device for determining a set of pitch cycle energy parameters, comprising:

a processor;

memory in electronic communication with the processor;

instructions stored in the memory, the instructions being executable to:

obtain a frame;

obtain a set of filter coefficients;

obtain a residual signal based on the frame and the set of filter coefficients;

determine a set of peak locations based on the residual signal;

segment the residual signal such that each segment of the residual signal includes one peak;

determine a first set of pitch cycle energy parameters based on a frame region between two consecutive peak locations;

map regions between peaks in the residual signal to regions between peaks in a synthesized excitation signal to produce a mapping; and determine a second set of pitch cycle energy parameters based on the first set of pitch cycle energy parameters and the mapping.

2. The electronic device of claim 1, wherein the instructions are further executable to send the second set of pitch cycle energy parameters.

3. The electronic device of claim 1, wherein the instructions are further executable to:

perform a linear prediction analysis using the frame and a signal prior to a current frame to obtain the set of filter coefficients; and determine a set of quantized filter coefficients based on the set of filter coefficients.

4. The electronic device of claim 3, wherein obtaining the residual signal is further based on the set of quantized filter coefficients.

5. The electronic device of claim 1, wherein the instructions are further executable to obtain the synthesized excitation signal.

6. The electronic device of claim 1, wherein determining a set of peak locations comprises:

calculating an envelope signal based on an absolute value of samples of the residual signal and a window signal;

calculating a first gradient signal based on a difference between the envelope signal and a time-shifted version of the envelope signal;

calculating a second gradient signal based on a difference between the first gradient signal and a time-shifted version of the first gradient signal;

selecting a first set of location indices where the a second gradient signal value falls below a first threshold;

determining a second set of location indices from the first set of location indices by eliminating location indices where an envelope value falls below a second threshold relative to a largest value in the envelope; and determining a third set of location indices from the second set of location indices by eliminating location indices that do not satisfy a difference threshold with respect to neighboring location indices.

7. The electronic device of claim 1, wherein the electronic device is a wireless communication device.

8. An electronic device for scaling an excitation, comprising:

a processor;

memory in electronic communication with the processor;

instructions stored in the memory, the instructions being executable to:

obtain a synthesized excitation signal, a set of pitch cycle energy parameters and a pitch lag;

segment the synthesized excitation signal into segments such that each segment contains one peak or such that each segment is of length equal to the pitch lag;

filter each segment to obtain synthesized segments;

determine scaling factors based on the synthesized segments and the set of pitch cycle energy parameters; and scale the segments using the scaling factors to obtain scaled segments.

9. The electronic device of claim 8, wherein the instructions are further executable to:

synthesize an audio signal based on the scaled segments; and update memory.

10. The electronic device of claim 8, wherein the synthesized excitation signal is segmented such that each segment contains one peak and the scaling factors are determined according to an equation $$S_{k,m} = \frac{E_k}{\sum_{i=0}^{L_k} x_m(i)},$$

wherein $S_{k,m}$ is a scaling factor for a $k^{th}$ segment, $E_k$ is a pitch cycle energy parameter for the $k^{th}$ segment, $L_k$ is a length of the $k^{th}$ segment and $x_m$ is a synthesized segment for a filter output m.

11. The electronic device of claim 8, wherein the synthesized excitation signal is segmented such that each segment is of length equal to the pitch lag and the instructions are further executable to:

determine a number of peaks within each of the segments; and determine whether the number of peaks within one of the segments is equal to one or greater than one.

12. The electronic device of claim 11, wherein the scaling factors are determined for a segment according to an equation $$S_{k,m} = \frac{E_k}{\sum_{i=0}^{L_k} x_m(i)},$$

wherein $S_{k,m}$ is a scaling factor for a $k^{th}$ segment, $E_k$ is a pitch cycle energy parameter for the $k^{th}$ segment, $L_k$ is a length of the $k^{th}$ segment and $x_m$ is a synthesized segment for a filter output m if the number of peaks within the segment is equal to one.

13. The electronic device of claim 11, wherein the scaling factors are determined for a segment based on a range including at most one peak if the number of peaks within the segment is greater than one.

14. The electronic device of claim 13, wherein the scaling factors are determined for a segment according to an equation $$S_{k,m} = \frac{E_k}{\sum_{i=j}^{n} x_m(i)},$$

wherein $S_{k,m}$ is a scaling factor for a $k^{th}$ segment, $E_k$ is a pitch cycle energy parameter for the $k^{th}$ segment, $L_k$ is a length of the $k^{th}$ segment, $x_m$ is a synthesized segment for a filter output m and j and n are indices selected to include at most one peak within the segment according to an equation $|n-j| \leq L_k$.

15. The electronic device of claim 8, wherein the electronic device is a wireless communication device.

16. A method for determining a set of pitch cycle energy parameters on an electronic device, comprising:

obtaining a frame;

obtaining a set of filter coefficients;

obtaining a residual signal based on the frame and the set of filter coefficients;

determining a set of peak locations based on the residual signal;

segmenting the residual signal such that each segment of the residual signal includes one peak;

determining a first set of pitch cycle energy parameters based on a frame region between two consecutive peak locations;

mapping regions between peaks in the residual signal to regions between peaks in a synthesized excitation signal to produce a mapping; and determining a second set of pitch cycle energy parameters based on the first set of pitch cycle energy parameters and the mapping.

17. The method of claim 16, further comprising sending the second set of pitch cycle energy parameters.

18. The method of claim 16, further comprising:

performing a linear prediction analysis using the frame and a signal prior to a current frame to obtain the set of filter coefficients; and determining a set of quantized filter coefficients based on the set of filter coefficients.

19. The method of claim 18, wherein obtaining the residual signal is further based on the set of quantized filter coefficients.

20. The method of claim 16, further comprising obtaining the synthesized excitation signal.

21. The method of claim 16, wherein determining a set of peak locations comprises:

calculating an envelope signal based on an absolute value of samples of the residual signal and a window signal;

calculating a first gradient signal based on a difference between the envelope signal and a time-shifted version of the envelope signal;

calculating a second gradient signal based on a difference between the first gradient signal and a time-shifted version of the first gradient signal;

selecting a first set of location indices where the a second gradient signal value falls below a first threshold;

determining a second set of location indices from the first set of location indices by eliminating location indices where an envelope value falls below a second threshold relative to a largest value in the envelope; and determining a third set of location indices from the second set of location indices by eliminating location indices that do not satisfy a difference threshold with respect to neighboring location indices.

22. The method of claim 16, wherein the electronic device is a wireless communication device.

23. A method for scaling an excitation on an electronic device, comprising:

obtaining a synthesized excitation signal, a set of pitch cycle energy parameters and a pitch lag;

segmenting the synthesized excitation signal into segments such that each segment contains one peak or such that each segment is of length equal to the pitch lag;

filtering each segment to obtain synthesized segments;

determining scaling factors based on the synthesized segments and the set of pitch cycle energy parameters; and scaling the segments using the scaling factors to obtain scaled segments.

24. The method of claim 23, further comprising:

synthesizing an audio signal based on the scaled segments; and updating memory.

25. The method of claim 23, wherein the synthesized excitation signal is segmented such that each segment contains one peak and the scaling factors are determined according to an equation $$S_{k,m} = \frac{E_k}{\sum_{i=0}^{L_k} x_m(i)},$$

wherein $S_{k,m}$ is a scaling factor for a $k^{th}$ segment, $E_k$ is a pitch cycle energy parameter for the $k^{th}$ segment, $L_k$ is a length of the $k^{th}$ segment and $x_m$ is a synthesized segment for a filter output m.

26. The method of claim 23, wherein the synthesized signal is segmented such that each segment is of length to the pitch lag, the method further comprising:

determining a number of peaks within each of the segments; and determining whether the number of peaks within one of the segments is equal to one or greater than one.

27. The method of claim 26, wherein the scaling factors are determined for a segment according to an equation $$S_{k,m} = \frac{E_k}{\sum_{i=0}^{L_k} x_m(i)},$$

wherein $S_{k,m}$ is a scaling factor for a $k^{th}$ segment, $E_k$ is a pitch cycle energy parameter for the $k^{th}$ segment, $L_k$ is a length of the $k^{th}$ segment and $x_m$ is a synthesized segment for a filter output m if the number of peaks within the segment is equal to one.

28. The method of claim 26, wherein the scaling factors are determined for a segment based on a range including at most one peak if the number of peaks within the segment is greater than one.

29. The method of claim 28, wherein the scaling factors are determined for a segment according to an equation $$S_{k,m} = \frac{E_k}{\sum_{i=j}^{n} x_m(i)},$$

wherein $S_{k,m}$ is a scaling factor for a $k^{th}$ segment, $E_k$ is a pitch cycle energy parameter for the $k^{th}$ segment, $L_k$ is a length of the $k^{th}$ segment, $x_m$ is a synthesized segment for a filter output m and j and n are indices selected to include at most one peak within the segment according to an equation $|n-j|L_k$.

30. The method of claim 23, wherein the electronic device is a wireless communication device.

31. A non-transitory computer-program product for determining a set of pitch cycle energy parameters, comprising a non-transitory tangible computer-readable medium having instructions thereon, the instructions comprising:

code for causing an electronic device to obtain a frame;

code for causing the electronic device to obtain a set of filter coefficients;

code for causing the electronic device to obtain a residual signal based on the frame and the set of filter coefficients;

code for causing the electronic device to determine a set of peak locations based on the residual signal;

code for causing the electronic device to segment the residual signal such that each segment of the residual signal includes one peak;

code for causing the electronic device to determine a first set of pitch cycle energy parameters based on a frame region between two consecutive peak locations;

code for causing the electronic device to map regions between peaks in the residual signal to regions between peaks in a synthesized excitation signal to produce a mapping.

32. A non-transitory computer-program product of claim 31, the instructions further comprising code for causing the electronic device to send the second set of pitch cycle energy parameters.

33. A non-transitory computer-program product for scaling an excitation, comprising a non-transitory tangible computer-readable medium having instructions thereon, the instructions comprising:

code for causing an electronic device to obtain a synthesized excitation signal, a set of pitch cycle energy parameters and a pitch lag;

code for causing the electronic device to segment the synthesized excitation signal into segments such that each segment contains one peak or such that each segment is of length equal to the pitch lag;

code for causing the electronic device to filter each segment to obtain synthesized segments;

code for causing the electronic device to determine scaling factors based on the synthesized segments and the set of pitch cycle energy parameters; and code for causing the electronic device to scale the segments using the scaling factors to obtain the segments.

34. The non-transitory computer-program product of claim 33, wherein the synthesized excitation signal is segmented such that each segment is of length equal to the pitch lag, the instructions further comprising:

code for causing the electronic device to determine a number of peaks within each of the segments; and code for causing the electronic device to determine whether the number of peaks within one of the segments is equal to one or greater than one.

35. The non-transitory computer-program product of claim 34, wherein the scaling factors are determined for a segment according to an equation $$S_{k,m} = \frac{E_k}{\sum_{i=0}^{L_k} x_m(i)},$$

wherein $S_{k,m}$ is a scaling factor for a $k^{th}$ segment, $E_k$ is a pitch cycle energy parameter for the $k^{th}$ segment, $L_k$ is a length of the $k^{th}$ segment and $x_m$ is a synthesized segment for a filter output m if the number of peaks within the segment is equal to one.

36. The non-transitory computer-program product of claim 34, wherein the scaling factors are determined for a segment based on a range including at most one peak if the number of peaks within the segment is greater than one.

37. An apparatus for determining a set of pitch cycle energy parameters, comprising:

means for obtaining a frame;

means for obtaining a set of filter coefficients;

means for obtaining a residual signal based on the frame and the set of filter coefficients;

means for determining a set of peak locations based on the residual signal;

means for segmenting the residual signal such that each segment of the residual signal includes one peak;

means for determining a first set of pitch cycle energy parameters based on a frame region between two consecutive peak locations;

means for mapping regions between peaks in the residual signal to regions between peaks in a synthesized excitation signal to produce a mapping; and means for determining a second set of pitch cycle energy parameters based on the first set of pitch cycle energy parameters and the mapping.

38. The apparatus of claim 37, further comprising means for sending the second set of pitch cycle energy parameters.

39. An apparatus for scaling an excitation, comprising:

means for obtaining a synthesized excitation signal, a set of pitch cycle energy parameters and a pitch lag;

means for segmenting the synthesized excitation signal into segments such that each segment contains one peak or such that each segment is of length equal to the pitch lag;

means for filtering each segment to obtain synthesized segments;

means for determining scaling factors based on the synthesized segments and the set of pitch cycle energy parameters; and means for scaling the segments using the scaling factors to obtain scaled segments.

40. The apparatus of claim 39, wherein the synthesized excitation signal is segmented such that each segment is of length equal to the pitch lag, the apparatus further comprising:

means for determining a number of peaks within each of the segments; and means for determining whether the number of peaks within one of the segments is equal to one or greater than one.

41. The apparatus of claim 40, wherein the means for determining the scaling factors comprises means for determining the scaling factors for a segment according to an equation $$S_{k,m} = \frac{E_k}{\sum_{i=0}^{L_k} x_m(i)},$$

wherein $S_{k,m}$ is a scaling factor for a $k^{th}$ segment, $E_k$ is a pitch cycle energy parameter for the $k^{th}$ segment, $L_k$ is a length of the $k^{th}$ segment and $x_m$ is a synthesized segment for a filter output m if the number of peaks within the segment is equal to one.

42. The apparatus of claim 40, wherein the means for determining the scaling factors comprises means for determining the scaling factors for a segment based on a range including at most one peak if the number of peaks within the segment is greater than one.

* * * * *